US009886960B2

(12) United States Patent
Wang

(10) Patent No.: US 9,886,960 B2
(45) Date of Patent: Feb. 6, 2018

(54) VOICE SIGNAL PROCESSING METHOD AND DEVICE

(71) Applicant: HUAWEI TECHNOLOGIES CO., LTD., Shenzhen, Guangdong (CN)

(72) Inventor: Zhe Wang, Beijing (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 18 days.

(21) Appl. No.: 14/951,968

(22) Filed: Nov. 25, 2015

(65) Prior Publication Data

US 2016/0078873 A1 Mar. 17, 2016

Related U.S. Application Data

(63) Continuation of application No. PCT/CN2013/084141, filed on Sep. 25, 2013.

(30) Foreign Application Priority Data

May 30, 2013 (CN) ..... 2013 1 0209760

(51) Int. Cl.
*G10L 19/012* (2013.01)
*G10L 19/022* (2013.01)
(Continued)

(52) U.S. Cl.
CPC ..... *G10L 19/012* (2013.01); *G10L 19/12* (2013.01); *G10L 19/167* (2013.01); *G10L 19/22* (2013.01)

(58) Field of Classification Search
CPC ..... G10L 19/012; G10L 19/028; G10L 25/03; G10L 25/78; G10L 25/84; G10L 19/022; G10L 19/07
(Continued)

(56) References Cited

U.S. PATENT DOCUMENTS 5,812,965 A 9/1998 Massaloux
5,819,218 A 10/1998 Hayata et al.
(Continued)

FOREIGN PATENT DOCUMENTS

CN 1200000 A 11/1998
CN 101303855 A 11/2008
(Continued)

OTHER PUBLICATIONS

Wang et al., "Linear Prediction Based Comfort Noise Generation in EVS Codec", 2015 IEEE International Conference on Acoustics, Speech and Signal Processing (ICASSP), Apr. 19-24, 2015, pp. 5903 to 5907.*
(Continued)

*Primary Examiner* — Martin Lerner
(74) *Attorney, Agent, or Firm* — Huawei Technologies Co., Ltd.

(57) ABSTRACT

A signal encoding method and device are disclosed. The method includes, when an encoding manner of a previous frame of a currently-input frame is a continuous encoding manner, predicting a comfort noise that is generated by a decoder according to the currently-input frame when the currently-input frame is encoded into an SID frame, determining an actual silence signal, determining a deviation degree between the comfort noise and the actual silence signal, determining an encoding manner of the currently-input frame according to the deviation degree, and encoding the currently-input frame according to the encoding manner of the currently-input frame. It is determined, according to the deviation degree between the comfort noise and the actual silence signal, that the encoding manner of the currently-input frame is the hangover frame encoding manner or the SID frame encoding manner, which can save communication bandwidth.

9 Claims, 6 Drawing Sheets

(51) Int. Cl.

| | |
|---|---|
| ***G10L 19/07*** | (2013.01) |
| ***G10L 25/03*** | (2013.01) |
| ***G10L 19/22*** | (2013.01) |
| ***G10L 19/12*** | (2013.01) |
| ***G10L 19/16*** | (2013.01) |

(58) Field of Classification Search
USPC ..... 704/210, 215, 226, 227
See application file for complete search history.

(56) References Cited

U.S. PATENT DOCUMENTS

| | | | | |
|---|---|---|---|---|
| 5,960,389 | A | 9/1999 | Jarvinen et al. | |
| 6,606,593 | B1 * | 8/2003 | Jarvinen | G10L 19/012 704/223 |
| 7,124,079 | B1 * | 10/2006 | Johansson | G10L 19/012 704/223 |
| 7,454,010 | B1 * | 11/2008 | Ebenezer | G10L 21/0208 379/392.01 |
| 7,983,906 | B2 * | 7/2011 | Gao | G10L 25/78 704/213 |
| 7,996,215 | B1 * | 8/2011 | Wang | G10L 25/78 370/352 |
| 9,443,526 | B2 * | 9/2016 | Jansson Toftgard | G10L 19/012 |
| 9,449,605 | B2 * | 9/2016 | Jiang | G10L 19/012 |
| 2001/0046843 | A1 * | 11/2001 | Alanara | G10L 19/012 455/95 |
| 2002/0120440 | A1 | 8/2002 | Zhang | |
| 2003/0065508 | A1 | 4/2003 | Tsuchinaga et al. | |
| 2005/0154584 | A1 | 7/2005 | Jelinek et al. | |
| 2006/0020449 | A1 | 1/2006 | Wong et al. | |
| 2006/0149536 | A1 * | 7/2006 | Li | G10L 19/012 704/215 |
| 2006/0293885 | A1 * | 12/2006 | Gournay | G10L 19/012 704/223 |
| 2007/0050189 | A1 | 3/2007 | Cruz-Zeno et al. | |
| 2009/0254341 | A1 * | 10/2009 | Yamamoto | G10L 25/78 704/233 |
| 2010/0036663 | A1 * | 2/2010 | Rangarao | G10L 25/78 704/240 |
| 2010/0106490 | A1 | 4/2010 | Svedberg et al. | |
| 2010/0324917 | A1 | 12/2010 | Shlomot et al. | |
| 2011/0184734 | A1 | 7/2011 | Wang et al. | |
| 2011/0228946 | A1 * | 9/2011 | Chen | G10L 19/012 381/61 |
| 2012/0232896 | A1 | 9/2012 | Taleb et al. | |
| 2012/0253813 | A1 * | 10/2012 | Katagiri | G10L 25/78 704/254 |
| 2013/0124196 | A1 | 5/2013 | Dai et al. | |
| 2015/0235648 | A1 * | 8/2015 | Jansson Toftgard | G10L 19/012 704/226 |

FOREIGN PATENT DOCUMENTS

| | | | |
|---|---|---|---|
| CN | 101320563 | A | 12/2008 |
| CN | 101430880 | A | 5/2009 |
| CN | 101496095 | A | 7/2009 |
| CN | 102044243 | A | 5/2011 |
| CN | 102903364 | A | 1/2013 |
| JP | H06242796 | A | 9/1994 |
| WO | 2008/121035 | A1 | 10/2008 |
| WO | 2011/049514 | A1 | 4/2011 |

OTHER PUBLICATIONS

Prasad et al., "Voice Activity Detection for VoIP—An Information Theoretic Approach", IEEE Global Telecommunications Conference, 2006, GLOBECOM '06, Nov. 27 to Dec. 1, 2006, 6 Pages.*

"Digital cellular telecommunications system (Phase 2+); Universal Mobile Telecommunications System (UMTS); AMR speech Codec; comfort noise for AMR Speech Traffic Channels (3GPP TS 26.092 version 6.0.0 Release 6)", ETSI TS 126 092 V6.0.0, Dec. 2004, total 14 pages.

"Digital cellular telecommunications system (Phase 2+); Universal Mobile Telecommunications System (UMTS); AMR speech Codec; Source Controlled Rate operation (3GPP TS 26.093 version 6.1.0 Release 6)", ETSI TS 126 093 V6.1.0, Jun. 2006, total 31 pages.

"Series G: Transmission Systems and Media, Digital Systems and Networks Digital terminal equipments—Coding of voice and audio signals", ITU-T G.718 Amendment 3, Mar. 2013, total 10 pages.

"Series G: Transmission Systems and Media, Digital Systems and Networks Digital terminal equipment—Coding of analogue signals by methods other than PCM", ITU-T G129, Jan. 2007, total 146 pages.

Adil Benyassine et al., "ITU-T Recommendation G. 729 Annex B: A Silence Compression Scheme for Use with G.729 Optimized for V.70 Digital Simultaneous Voice and Data Applications," IEEE Communications Magazine, pp. 64-73, Sep. 1997.

Bruno Bessette et al., "The Adaptive Multirate Wideband Speech Codec (AMR-WB)," IEEE Transactions on Speech and Audio Processing, vol. 10, No. 8, pp. 620-636, Nov. 2002.

* cited by examiner

VOICE SIGNAL PROCESSING METHOD AND DEVICE

CROSS-REFERENCE TO RELATED APPLICATIONS

This application is a continuation of International Application No. PCT/CN2013/084141, filed on Sep. 25, 2013, which claims priority to Chinese Patent Application No. 201310209760.9, filed on May 30, 2013, both of which are hereby incorporated by reference in their entireties.

TECHNICAL FIELD

The present invention relates to the field of signal processing, and in particular, to a signal encoding method and device.

BACKGROUND

A discontinuous transmission (DTX) system is a widely-applied voice communication system, where in a silence period of voice communication, a manner of discontinuously encoding and transmitting a voice frame can be used to reduce occupation of channel bandwidth, and meanwhile, adequate subjective call quality can still be ensured.

Voice signals may be usually classified into two types, namely, an active voice signal and a silence signal. The active voice signal refers to a signal including a call voice, and the silence signal refers to a signal not including a call voice. In the DTX system, the active voice signal is transmitted by using a continuous transmission method, and the silence signal is transmitted by using a discontinuous transmission method. The discontinuous transmission of the silence signal is implemented in the following manner: an encoder intermittently encodes and sends a special encoding frame, namely, a silence descriptor (SID) frame, where in the DTX system, none of any other signal frame is encoded between two adjacent SID frames. A decoder discretionarily generates, according to discontinuously-received SID frames, a noise that enables comfortable subjective hearing of a user. The comfort noise (CN) does not aim to accurately restore an original silence signal, but aims to satisfy a requirement of a decoder user on subjective hearing quality, and enable the user not to feel uncomfortable.

In order to obtain better subjective hearing quality at the decoder, quality of transition from an active voice band to a CN band is critical. To obtain smoother transition, one effective method is that: during transition from an active voice band to a silence band, the encoder does not transit to a discontinuous transmission state immediately, but additionally delays for a period of time. In this period of time, some silence frames at the beginning of the silence band are still considered as active voice frames and are continuously encoded and sent, that is, a hangover interval of continuous transmission is set. The advantage of this measure lies in that: the decoder can fully use a silence signal within the hangover interval to better estimate and extract a feature of the silence signal, so as to generate a better CN.

However, in the prior art, a hangover mechanism is not effectively controlled. A condition for triggering the hangover mechanism is relatively simple, that is, whether to trigger the hangover mechanism is determined by simply checking whether there are enough active voice frames to be continuously encoded and sent at the end of a voice activity; after the hangover mechanism is triggered, a hangover interval at a fixed length may be executed compulsorily.

However, it is unnecessary that a hangover interval at a fixed length must be executed when there are enough active voice frames to be continuously encoded and sent, for example, when a background noise of a communication environment is stable, even if no hangover interval is set or a short hangover interval is set, the decoder can obtain a CN having better quality. Therefore, this mode of simply controlling the hangover mechanism causes waste of communication bandwidth.

SUMMARY

Embodiments of the present invention provide a signal encoding method and device, which can save communication bandwidth.

According to a first aspect, a signal encoding method is provided, including: in a case in which an encoding manner of a previous frame of a currently-input frame is a continuous encoding manner, predicting a comfort noise that is generated by a decoder according to the currently-input frame in a case in which the currently-input frame is encoded into a silence descriptor SID frame, and determining an actual silence signal, where the currently-input frame is a silence frame; determining a deviation degree between the comfort noise and the actual silence signal; determining an encoding manner of the currently-input frame according to the deviation degree, where the encoding manner of the currently-input frame includes a hangover frame encoding manner or an SID frame encoding manner; and encoding the currently-input frame according to the encoding manner of the currently-input frame.

With reference to the first aspect, in a first possible implementation manner, the predicting a comfort noise that is generated by a decoder according to the currently-input frame in a case in which the currently-input frame is encoded into an SID frame, and determining an actual silence signal includes: predicting a feature parameter of the comfort noise, and determining a feature parameter of the actual silence signal, where the feature parameter of the comfort noise is in a one-to-one correspondence to the feature parameter of the actual silence signal; and the determining a deviation degree between the comfort noise and the actual silence signal includes: determining a distance between the feature parameter of the comfort noise and the feature parameter of the actual silence signal.

With reference to the first possible implementation manner of the first aspect, in a second possible implementation manner, the determining an encoding manner of the currently-input frame according to the deviation degree includes: determining, in a case in which the distance between the feature parameter of the comfort noise and the feature parameter of the actual silence signal is less than a corresponding threshold in a threshold set, that the encoding manner of the currently-input frame is the SID frame encoding manner, where the distance between the feature parameter of the comfort noise and the feature parameter of the actual silence signal is in a one-to-one correspondence to the threshold in the threshold set; and determining, in a case in which the distance between the feature parameter of the comfort noise and the feature parameter of the actual silence signal is greater than or equal to the corresponding threshold in the threshold set, that the encoding manner of the currently-input frame is the hangover frame encoding manner.

With reference to the first possible implementation manner or the second possible implementation manner of the first aspect, in a third possible implementation manner, the feature parameter of the comfort noise is used for representing at least one of the following information: energy information and spectral information.

With reference to the third possible implementation manner of the first aspect, in a fourth possible implementation manner, the energy information includes code excited linear prediction CELP excitation energy;

the spectral information includes at least one of the following: a linear predictive filter coefficient, a fast Fourier transform FFT coefficient, and a modified discrete cosine transform MDCT coefficient; and the linear predictive filter coefficient includes at least one of the following: a line spectral frequency LSF coefficient, a line spectrum pair LSP coefficient, an immittance spectral frequency ISF coefficient, an immittance spectral pair ISP coefficient, a reflection coefficient, and a linear predictive coding LPC coefficient.

With reference to any implementation manner of the first possible implementation manner to the fourth possible implementation manner of the first aspect, in a fifth possible implementation manner, the predicting a feature parameter of the comfort noise includes: predicting the feature parameter of the comfort noise according to a comfort noise parameter of the previous frame of the currently-input frame and a feature parameter of the currently-input frame; or predicting the feature parameter of the comfort noise according to feature parameters of L hangover frames preceding the currently-input frame and a feature parameter of the currently-input frame, where L is a positive integer.

With reference to any implementation manner of the first possible implementation manner to the fifth possible implementation manner of the first aspect, in a sixth possible implementation manner, the determining a feature parameter of the actual silence signal includes: determining that the feature parameter of the currently-input frame is the feature parameter of the actual silence signal; or collecting statistics on feature parameters of M silence frames, to determine the feature parameter of the actual silence signal.

With reference to the sixth possible implementation manner of the first aspect, in a seventh possible implementation manner, the M silence frames include the currently-input frame and (M−1) silence frames preceding the currently-input frame, where M is a positive integer.

With reference to the second possible implementation manner of the first aspect, in an eighth possible implementation manner, the feature parameter of the comfort noise includes code excited linear prediction CELP excitation energy of the comfort noise and a line spectral frequency LSF coefficient of the comfort noise, and the feature parameter of the actual silence signal includes CELP excitation energy of the actual silence signal and an LSF coefficient of the actual silence signal; and the determining a distance between the feature parameter of the comfort noise and the feature parameter of the actual silence signal includes: determining a distance De between the CELP excitation energy of the comfort noise and the CELP excitation energy of the actual silence signal, and determining a distance Dlsf between the LSF coefficient of the comfort noise and the LSF coefficient of the actual silence signal.

With reference to the eighth possible implementation manner of the first aspect, in a ninth possible implementation manner, the determining, in a case in which the distance between the feature parameter of the comfort noise and the feature parameter of the actual silence signal is less than a corresponding threshold in a threshold set, that the encoding manner of the currently-input frame is the SID frame encoding manner includes: in a case in which the distance De is less than a first threshold and the distance Dlsf is less than a second threshold, determining that the encoding manner of the currently-input frame is the SID frame encoding manner; and the determining, in a case in which the distance between the feature parameter of the comfort noise and the feature parameter of the actual silence signal is greater than or equal to the corresponding threshold in the threshold set, that the encoding manner of the currently-input frame is the hangover frame encoding manner includes: in a case in which the distance De is greater than or equal to the first threshold or the distance Dlsf is greater than or equal to the second threshold, determining that the encoding manner of the currently-input frame is the hangover frame encoding manner.

With reference to the ninth possible implementation manner of the first aspect, in a tenth possible implementation manner, the method further includes: acquiring the preset first threshold and the preset second threshold; or determining the first threshold according to CELP excitation energy of N silence frames preceding the currently-input frame, and determining the second threshold according to LSF coefficients of the N silence frames, where N is a positive integer.

With reference to the first aspect or any implementation manner of the first possible implementation manner to the tenth possible implementation manner of the first aspect, in an eleventh possible implementation manner, the predicting a comfort noise that is generated by a decoder according to the currently-input frame in a case in which the currently-input frame is encoded into an SID frame includes: predicting the comfort noise in a first prediction manner, where the first prediction manner is the same as a manner in which the decoder generates the comfort noise.

According to a second aspect, a signal processing method is provided, including: determining a group weighted spectral distance of each silence frame in P silence frames, where the group weighted spectral distance of each silence frame in the P silence frames is the sum of weighted spectral distances between each silence frame in the P silence frames and the other (P−1) silence frames, where P is a positive integer; and determining a first spectral parameter according to the group weighted spectral distance of each silence frame in the P silence frames, where the first spectral parameter is used for generating a comfort noise.

With reference to the second aspect, in a first possible implementation manner, each silence frame corresponds to one group of weighting coefficients, where in the one group of weighting coefficients, a weighting coefficient corresponding to a first group of subbands is greater than a weighting coefficient corresponding to a second group of subbands, and perceptual importance of the first group of subbands is greater than perceptual importance of the second group of subbands.

With reference to the second aspect or the first possible implementation manner of the second aspect, in a second possible implementation manner, the determining a first spectral parameter according to the group weighted spectral distance of each silence frame in the P silence frames includes: selecting a first silence frame from the P silence frames, so that a group weighted spectral distance of the first silence frame in the P silence frames is the smallest; and determining that a spectral parameter of the first silence frame is the first spectral parameter.

With reference to the second aspect or the first possible implementation manner of the second aspect, in a third possible implementation manner, the determining a first spectral parameter according to the group weighted spectral distance of each silence frame in the P silence frames includes: selecting at least one silence frame from the P silence frames, so that a group weighted spectral distance of the at least one silence frame in the P silence frames is less than a third threshold; and determining the first spectral parameter according to a spectral parameter of the at least one silence frame.

With reference to the second aspect or any implementation manner of the first possible implementation manner to the third possible implementation manner of the second aspect, in a fourth possible implementation manner, the P silence frames include a currently-input silence frame and (P−1) silence frames preceding the currently-input silence frame.

With reference to the fourth possible implementation manner of the second aspect, in a fifth possible implementation manner, the method further includes: encoding the currently-input silence frame into a silence descriptor SID frame, where the SID frame includes the first spectral parameter.

According to a third aspect, a signal processing method is provided, including: dividing a frequency band of an input signal into R subbands, where R is a positive integer; determining, on each subband of the R subbands, a subband group spectral distance of each silence frame in S silence frames, where the subband group spectral distance of each silence frame in the S silence frames is the sum of spectral distances between each silence frame in the S silence frames on each subband and the other (S−1) silence frames, and S is a positive integer; and determining, on each subband, a first spectral parameter of each subband according to the subband group spectral distance of each silence frame in the S silence frames, where the first spectral parameter of each subband is used for generating a comfort noise.

With reference to the third aspect, in a first possible implementation manner, the determining, on each subband, a first spectral parameter of each subband according to the subband group spectral distance of each silence frame in the S silence frames includes: selecting, on each subband, a first silence frame from the S silence frames, so that a subband group spectral distance of the first silence frame in the S silence frames on each subband is the smallest; and determining, on each subband, that a spectral parameter of the first silence frame is the first spectral parameter of each subband.

With reference to the third aspect, in a second possible implementation manner, the determining, on each subband, a first spectral parameter of each subband according to the subband group spectral distance of each silence frame in the S silence frames includes: selecting, on each subband, at least one silence frame from the S silence frames, so that a subband group spectral distance of the at least one silence frame is less than a fourth threshold; and determining, on each subband, the first spectral parameter of each subband according to a spectral parameter of the at least one silence frame.

With reference to the third aspect or the first possible implementation manner or the second possible implementation manner of the third aspect, in a third possible implementation manner, the S silence frames include a currently-input silence frame and (S−1) silence frames preceding the currently-input silence frame.

With reference to the third possible implementation manner of the third aspect, in a fourth possible implementation manner, the method further includes: encoding the currently-input silence frame into a silence descriptor SID frame, where the SID frame includes the first spectral parameter of each subband.

According to a fourth aspect, a signal processing method is provided, including: determining a first parameter of each silence frame in T silence frames, where the first parameter is used for representing spectral entropy, and T is a positive integer; and determining a first spectral parameter according to the first parameter of each silence frame in the T silence frames, where the first spectral parameter is used for generating a comfort noise.

With reference to the fourth aspect, in a first possible implementation manner, the determining a first spectral parameter according to the first parameter of each silence frame in the T silence frames includes: in a case in which it is determined that the T silence frames can be classified into a first group of silence frames and a second group of silence frames according to a clustering criterion, determining the first spectral parameter according to a spectral parameter of the first group of silence frames, where spectral entropy represented by first parameters of the first group of silence frames is greater than spectral entropy represented by first parameters of the second group of silence frames; and in a case in which it is determined that the T silence frames cannot be classified into the first group of silence frames and the second group of silence frames according to the clustering criterion, performing weighted averaging on spectral parameters of the T silence frames, to determine the first spectral parameter, where the spectral entropy represented by the first parameters of the first group of silence frames is greater than the spectral entropy represented by the first parameters of the second group of silence frames.

With reference to the first possible implementation manner of the fourth aspect, in a second possible implementation manner, the clustering criterion includes: a distance between a first parameter of each silence frame in the first group of silence frames and a first average value is less than or equal to a distance between the first parameter of each silence frame in the first group of silence frames and a second average value; a distance between a first parameter of each silence frame in the second group of silence frames and the second average value is less than or equal to a distance between the first parameter of each silence frame in the second group of silence frames and the first average value; a distance between the first average value and the second average value is greater than an average distance between the first parameters of the first group of silence frames and the first average value; and the distance between the first average value and the second average value is greater than an average distance between the first parameters of the second group of silence frames and the second average value, where the first average value is an average value of the first parameters of the first group of silence frames, and the second average value is an average value of the first parameters of the second group of silence frames.

With reference to the fourth aspect, in a third possible implementation manner, the determining a first spectral parameter according to the first parameter of each silence frame in the T silence frames includes:

performing weighted averaging on spectral parameters of the T silence frames, to determine the first spectral parameter, where for the $i^{th}$ silence frame and the $j^{th}$ silence frame, which are different, in the T silence frames, a weighting coefficient corresponding to the $i^{th}$ silence frame is greater than or equal to a weighting coefficient corresponding to the $j^{th}$ silence frame; when the first parameter is positively correlated with the spectral entropy, a first parameter of the $i^{th}$ silence frame is greater than a first parameter of the $j^{th}$ silence frame; and when the first parameter is negatively correlated with the spectral entropy, the first parameter of the $i^{th}$ silence frame is less than the first parameter of the $j^{th}$ silence frame, where i and j are both positive integers, and $1 \leq i \leq T$, and $1 \leq j \leq T$.

With reference to fourth aspect or any implementation manner of the first possible implementation manner to the third possible implementation manner of the fourth aspect, in a fourth possible implementation manner, the T silence frames include a currently-input silence frame and (T−1) silence frames preceding the currently-input silence frame.

With reference to the fourth possible implementation manner of the fourth aspect, in a fifth possible implementation manner, the method further includes: encoding the currently-input silence frame into a silence descriptor SID frame, where the SID frame includes the first spectral parameter.

According to a fifth aspect, a signal encoding device is provided, including: a first determining unit, configured to: in a case in which an encoding manner of a previous frame of a currently-input frame is a continuous encoding manner, predict a comfort noise that is generated by a decoder according to the currently-input frame in a case in which the currently-input frame is encoded into a silence descriptor SID frame, and determine an actual silence signal, where the currently-input frame is a silence frame; a second determining unit, configured to determine a deviation degree between the comfort noise determined by the first determining unit and the actual silence signal determined by the first determining unit; a third determining unit, configured to determine an encoding manner of the currently-input frame according to the deviation degree determined by the second determining unit, where the encoding manner of the currently-input frame includes a hangover frame encoding manner or an SID frame encoding manner; and an encoding unit, configured to encode the currently-input frame according to the encoding manner of the currently-input frame determined by the third determining unit.

With reference to the fifth aspect, in a first possible implementation manner, the first determining unit is specifically configured to predict a feature parameter of the comfort noise, and determine a feature parameter of the actual silence signal, where the feature parameter of the comfort noise is in a one-to-one correspondence to the feature parameter of the actual silence signal; and the second determining unit is specifically configured to determine a distance between the feature parameter of the comfort noise and the feature parameter of the actual silence signal.

With reference to the first possible implementation manner of the fifth aspect, in a second possible implementation manner, the third determining unit is specifically configured to: in a case in which the distance between the feature parameter of the comfort noise and the feature parameter of the actual silence signal is less than a corresponding threshold in a threshold set, determine that the encoding manner of the currently-input frame is the SID frame encoding manner, where the distance between the feature parameter of the comfort noise and the feature parameter of the actual silence signal is in a one-to-one correspondence to the threshold in the threshold set; and in a case in which the distance between the feature parameter of the comfort noise and the feature parameter of the actual silence signal is greater than or equal to the corresponding threshold in the threshold set, determine that the encoding manner of the currently-input frame is the hangover frame encoding manner.

With reference to the first possible implementation manner or the second possible implementation manner of the fifth aspect, in a third possible implementation manner, the first determining unit is specifically configured to: predict the feature parameter of the comfort noise according to a comfort noise parameter of the previous frame of the currently-input frame and a feature parameter of the currently-input frame; or predict the feature parameter of the comfort noise according to feature parameters of L hangover frames preceding the currently-input frame and a feature parameter of the currently-input frame, where L is a positive integer.

With reference to the first possible implementation manner or the second possible implementation manner or the third possible implementation manner of the fifth aspect, in a fourth possible implementation manner, the first determining unit is specifically configured to: determine that the feature parameter of the currently-input frame is the parameter of the actual silence signal; or collect statistics on feature parameters of M silence frames, to determine the parameter of the actual silence signal.

With reference to the second possible implementation manner of the fifth aspect, in a fifth possible implementation manner, the feature parameter of the comfort noise includes code excited linear prediction CELP excitation energy of the comfort noise and a line spectral frequency LSF coefficient of the comfort noise, and the feature parameter of the actual silence signal includes CELP excitation energy of the actual silence signal and an LSF coefficient of the actual silence signal; and the second determining unit is specifically configured to determine a distance De between the CELP excitation energy of the comfort noise and the CELP excitation energy of the actual silence signal, and determine a distance Dlsf between the LSF coefficient of the comfort noise and the LSF coefficient of the actual silence signal.

With reference to the fifth possible implementation manner of the fifth aspect, in a sixth possible implementation manner, the third determining unit is specifically configured to: in a case in which the distance De is less than a first threshold and the distance Dlsf is less than a second threshold, determine that the encoding manner of the currently-input frame is the SID frame encoding manner; and the third determining unit is specifically configured to: in a case in which the distance De is greater than or equal to the first threshold or the distance Dlsf is greater than or equal to the second threshold, determine that the encoding manner of the currently-input frame is the hangover frame encoding manner.

With reference to the sixth possible implementation manner of the fifth aspect, in a seventh possible implementation manner, the device further includes a fourth determining unit, configured to: acquire the preset first threshold and the preset second threshold; or determine the first threshold according to CELP excitation energy of N silence frames preceding the currently-input frame, and determine the second threshold according to LSF coefficients of the N silence frames, where N is a positive integer.

With reference to the fifth aspect or any implementation manner of the first possible implementation manner to the seventh possible implementation manner of the fifth aspect, in an eighth possible implementation manner, the first determining unit is specifically configured to predict the comfort noise in a first prediction manner, where the first prediction manner is the same as a manner in which the decoder generates the comfort noise.

According to a sixth aspect, a signal processing device is provided, including: a first determining unit, configured to determine a group weighted spectral distance of each silence frame in P silence frames, where the group weighted spectral distance of each silence frame in the P silence frames is the sum of weighted spectral distances between each silence frame in the P silence frames and the other (P−1) silence frames, where P is a positive integer; and a second determining unit, configured to determine a first spectral parameter according to the group weighted spectral distance, determined by the first determining unit, of each silence frame in the P silence frames, where the first spectral parameter is used for generating a comfort noise.

With reference to the sixth aspect, in a first possible implementation manner, the second determining unit is specifically configured to: select a first silence frame from the P silence frames, so that a group weighted spectral distance of the first silence frame in the P silence frames is the smallest; and determine that a spectral parameter of the first silence frame is the first spectral parameter.

With reference to the sixth aspect, in a second possible implementation manner, the second determining unit is specifically configured to: select at least one silence frame from the P silence frames, so that a group weighted spectral distance of the at least one silence frame in the P silence frames is less than a third threshold; and determine the first spectral parameter according to a spectral parameter of the at least one silence frame.

With reference to the sixth aspect or the first possible implementation manner or the second possible implementation manner of the sixth aspect, in a third possible implementation manner, the P silence frames include a currently-input silence frame and (P−1) silence frames preceding the currently-input silence frame; and the device further includes: an encoding unit, configured to encode the currently-input silence frame into a silence descriptor SID frame, where the SID frame includes the first spectral parameter determined by the second determining unit.

According to a seventh aspect, a signal processing device is provided, including: a dividing unit, configured to divide a frequency band of an input signal into R subbands, where R is a positive integer; a first determining unit, configured to determine, on each subband of the R subbands obtained after the dividing unit performs the division, a subband group spectral distance of each silence frame in S silence frames, where the subband group spectral distance of each silence frame in the S silence frames is the sum of spectral distances between each silence frame in the S silence frames on each subband and the other (S−1) silence frames, and S is a positive integer; and a second determining unit, configured to determine, on each subband obtained after the dividing unit performs the division, a first spectral parameter of each subband according to the subband group spectral distance, determined by the first determining unit, of each silence frame in the S silence frames, where the first spectral parameter of each subband is used for generating a comfort noise.

With reference to the seventh aspect, in a first possible implementation manner, the second determining unit is specifically configured to: select, on each subband, a first silence frame from the S silence frames, so that a subband group spectral distance of the first silence frame in the S silence frames on each subband is the smallest; and determine, on each subband, that a spectral parameter of the first silence frame is the first spectral parameter of each subband.

With reference to the seventh aspect, in a second possible implementation manner, the second determining unit is specifically configured to: select, on each subband, at least one silence frame from the S silence frames, so that a subband group spectral distance of the at least one silence frame is less than a fourth threshold; and determine, on each subband, the first spectral parameter of each subband according to a spectral parameter of the at least one silence frame.

With reference to the seventh aspect or the first possible implementation manner or the second possible implementation manner of the seventh aspect, in a third possible implementation manner, the S silence frames include a currently-input silence frame and (S−1) silence frames preceding the currently-input silence frame; and the device further includes: an encoding unit, configured to encode the currently-input silence frame into a silence descriptor SID frame, where the SID frame includes the first spectral parameter of each subband.

According to an eighth aspect, a signal processing device is provided, including: a first determining unit, configured to determine a first parameter of each silence frame in T silence frames, where the first parameter is used for representing spectral entropy, and T is a positive integer; and a second determining unit, configured to determine a first spectral parameter according to the first parameter, determined by the first determining unit, of each silence frame in the T silence frames, where the first spectral parameter is used for generating a comfort noise.

With reference to the eighth aspect, in a first possible implementation manner, the second determining unit is specifically configured to: in a case in which it is determined that the T silence frames can be classified into a first group of silence frames and a second group of silence frames according to a clustering criterion, determine the first spectral parameter according to a spectral parameter of the first group of silence frames, where spectral entropy represented by first parameters of the first group of silence frames is greater than spectral entropy represented by first parameters of the second group of silence frames; and in a case in which it is determined that the T silence frames cannot be classified into the first group of silence frames and the second group of silence frames according to the clustering criterion, perform weighted averaging on spectral parameters of the T silence frames, to determine the first spectral parameter, where the spectral entropy represented by the first parameters of the first group of silence frames is greater than the spectral entropy represented by the first parameters of the second group of silence frames.

With reference to the eighth aspect, in a second possible implementation manner, the second determining unit is specifically configured to perform weighted averaging on spectral parameters of the T silence frames, to determine the first spectral parameter, where for the $i^{th}$ silence frame and the $j^{th}$ silence frame, which are different, in the T silence frames, a weighting coefficient corresponding to the $i^{th}$ silence frame is greater than or equal to a weighting coefficient corresponding to the $j^{th}$ silence frame; when the first parameter is positively correlated with the spectral entropy, a first parameter of the $i^{th}$ silence frame is greater than a first parameter of the $j^{th}$ silence frame; and when the first parameter is negatively correlated with the spectral entropy, the first parameter of the $i^{th}$ silence frame is less than the first parameter of the $j^{th}$ silence frame, where i and j are both positive integers, and $1 \le i \le T$, and $1 \le j \le T$.

With reference to the eighth aspect or the first possible implementation manner or the second possible implementation manner of the eighth aspect, in a third possible implementation manner, the T silence frames include a currently-input silence frame and (T−1) silence frames preceding the currently-input silence frame; and the device further includes: an encoding unit, configured to encode the currently-input silence frame into a silence descriptor SID frame, where the SID frame includes the first spectral parameter.

In the embodiments of the present invention, in a case in which an encoding manner of a previous frame of a currently-input frame is a continuous encoding manner, a comfort noise that is generated by a decoder according to the currently-input frame in a case in which the currently-input frame is encoded into an SID frame is predicted, a deviation degree between the comfort noise and an actual silence signal is determined, and it is determined, according to the deviation degree, that an encoding manner of the currently-input frame is a hangover frame encoding manner or an SID frame encoding manner, rather than that the currently-input frame is encoded into a hangover frame simply according to a quantity, obtained through statistics collection, of active voice frames, thereby saving communication bandwidth.

BRIEF DESCRIPTION OF DRAWINGS

To describe the technical solutions in the embodiments of the present invention more clearly, the following briefly introduces the accompanying drawings required for describing the embodiments of the present invention. Apparently, the accompanying drawings in the following description show merely some embodiments of the present invention, and a person of ordinary skill in the art may still derive other drawings from these accompanying drawings without creative efforts.

DESCRIPTION OF EMBODIMENTS

The following clearly describes the technical solutions in the embodiments of the present invention with reference to the accompanying drawings in the embodiments of the present invention. Apparently, the described embodiments are some but not all of the embodiments of the present invention. All other embodiments obtained by a person of ordinary skill in the art based on the embodiments of the present invention without creative efforts shall fall within the protection scope of the present invention.

Figure 1:
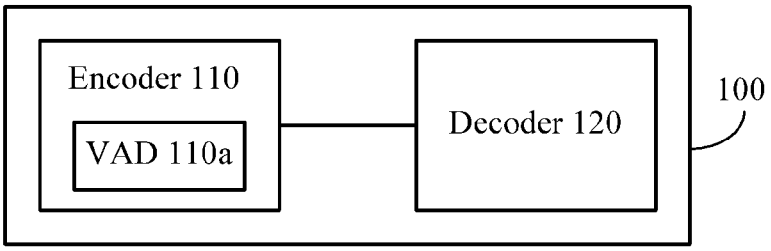
FIG. 1 is a block diagram of a voice communication system according to an embodiment of the present invention.

FIG. 1 is a schematic block diagram of a voice communication system according to an embodiment of the present invention.

A system 100 in FIG. 1 may be a DTX system. The system 100 may include an encoder 110 and a decoder 120.

The encoder 110 may truncate an input time-domain voice signal into a voice frame, encode the voice frame, and send the encoded voice frame to the decoder 120. The decoder 120 may receive the encoded voice frame from the encoder 110, decode the encoded voice frame, and output the decoded time-domain voice signal.

The encoder 110 may further include a voice activity detector (VAD) 110*a*. The VAD 110*a* may detect whether a currently-input voice frame is an active voice frame or a silence frame. The active voice frame may represent a frame including a call voice signal, and the silence frame may represent a frame not including a call voice signal. Herein, the silence frame may include a mute frame whose energy is less than a silence threshold, or may also include a background noise frame. The encoder 110 may have two working statuses, that is, a continuous transmission state and a discontinuous transmission state. When the encoder 110 works in the continuous transmission state, the encoder 110 may encode each input voice frame and send the encoded frame. When the encoder 110 works in the discontinuous transmission state, the encoder 110 may not encode an input voice frame, or may encode the voice frame into an SID frame. Generally, only when the input voice frame is a silence frame, the encoder 110 works in the discontinuous transmission state.

When a currently-input silence frame is the first frame after the end of an active voice band, where the active voice band includes a hangover interval that may exist, the encoder 110 may encode the silence frame into an SID frame, where SID_FIRST may be used for representing the SID frame. When the currently-input silence frame is the $n^{th}$ frame after a previous SID frame, where n is a positive integer, and there is no active voice frame between the currently-input silence frame and the previous SID frame, the encoder 110 may encode the silence frame into an SID frame, where SID_UPDATE may be used for representing the SID frame.

The SID frame may include some information describing a feature of a silence signal. The decoder can generate a comfort noise according to the feature information. For example, the SID frame may include energy information and spectral information of the silence signal. Further, for example, the energy information of the silence signal may include energy of an excitation signal in a code exited linear prediction (CELP) model, or time-domain energy of the silence signal. The spectral information may include a line spectral frequency (LSF) coefficient, a line spectrum pair (LSP) coefficient, an immittance spectral frequency (ISF)

coefficient, an immittance spectral pair (ISP) coefficient, a linear predictive coding (LPC) coefficient, a fast Fourier transform (FFT) coefficient, or a modified discrete cosine transform (MDCT) coefficient, or the like.

The encoded voice frame may include three types: an encoded voice frame, an SID frame, and a NO_DATA frame. The encoded voice frame is a frame that is encoded by the encoder 110 in a continuous transmission state, and the NO_DATA frame may represent a frame having no encoded bit, that is, a frame that does not exist physically, such as a silence frame that is not encoded and between SID frames.

The decoder 120 may receive an encoded voice frame from the encoder 110, and decode the encoded voice frame. When the encoded voice frame is received, the decoder may directly decode the frame and output a time-domain voice frame. When an SID frame is received, the decoder may decode the SID frame, and obtain hangover length information, energy information, and spectral information in the SID frame. Specifically, when the SID frame is SID UPDATE, the decoder may obtain energy information and spectral information of a silence signal, that is, obtain a CN parameter, according to the information in the current SID frame, or according to the information in the current SID frame and with reference to other information, so as to generate a time-domain CN frame according to the CN parameter. When the SID frame is SID_FIRST, the decoder obtains, according to the hangover length information in the SID frame, statistics information of energy and spectra in m frames preceding the frame, and obtains a CN parameter with reference to information that is obtained through decoding and is in the SID frame, so as to generate a time-domain CN frame, where m is a positive integer. When a NO_DATA frame is input to the decoder, the decoder obtains a CN parameter according to a recently-received SID frame and with reference to other information, so as to generate a time-domain CN frame.

Figure 2:
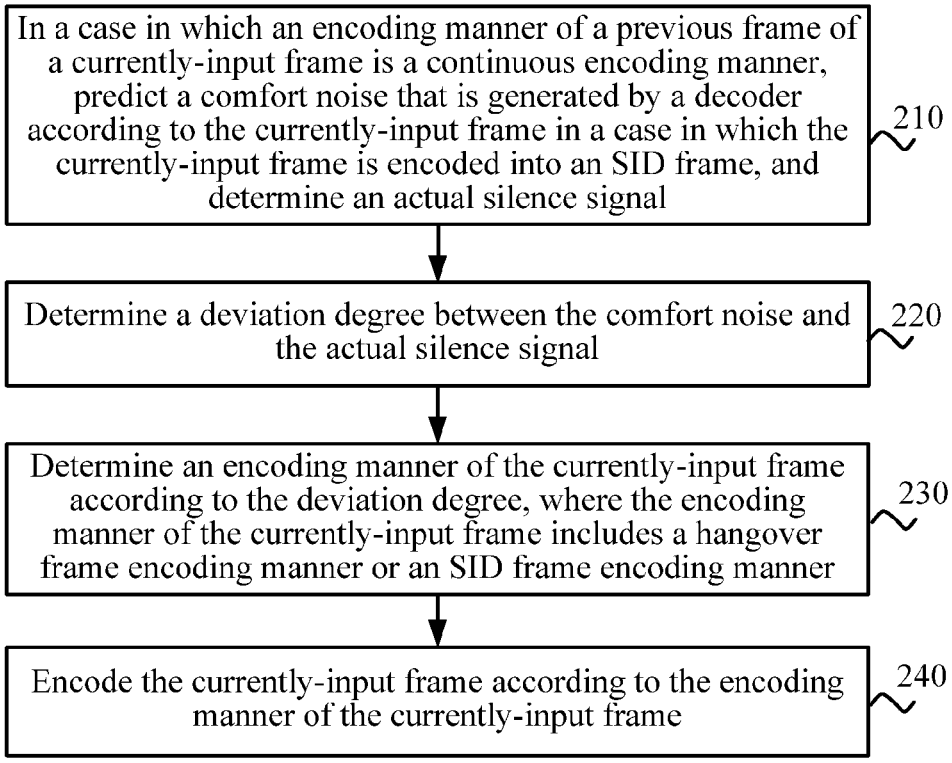
FIG. 2 is a flowchart of a signal encoding method according to an embodiment of the present invention.

FIG. 2 is a flowchart 200 of a signal encoding method according to an embodiment of the present invention. The method in FIG. 2 is executed by an encoder, such as for example, may be executed by the encoder 110 in FIG. 1.

210: In a case in which an encoding manner of a previous frame of a currently-input frame is a continuous encoding manner, predict a comfort noise that is generated by a decoder according to the currently-input frame in a case in which the currently-input frame is encoded into an SID frame, and determine an actual silence signal, where the currently-input frame is a silence frame.

In this embodiment of the present invention, the actual silence signal may refer to an actual silence signal input into the encoder.

220: Determine a deviation degree between the comfort noise and the actual silence signal.

230: Determine an encoding manner of the currently-input frame according to the deviation degree, where the encoding manner of the currently-input frame includes a hangover frame encoding manner or an SID frame encoding manner.

Specifically, the hangover frame encoding manner may refer to a continuous encoding manner. The encoder may encode a silence frame in a hangover interval in the continuous encoding manner, and a frame obtained through encoding may be referred to as a hangover frame.

240: Encode the currently-input frame according to the encoding manner of the currently-input frame.

In step 210, the encoder may determine, according to different factors, to encode the previous frame of the currently-input frame in the continuous encoding manner, for example, if a VAD in the encoder determines that the previous frame is in an active voice band or the encoder determines that the previous frame is in a hangover interval, the encoder may encode the previous frame in the continuous encoding manner.

After an input voice signal enters a silence band, the encoder may determine, according to an actual situation, whether to work in a continuous transmission state or a discontinuous transmission state. Therefore, for the currently-input frame used as the silence frame, the encoder needs to determine how to encode the currently-input frame.

The currently-input frame may be the first silence frame after the input voice signal enters the silence band, or may also be the $n^{th}$ frame after the input voice signal enters the silence band, where n is a positive integer greater than 1.

If the currently-input frame is the first silence frame, in step 230, that the encoder determines an encoding manner of the currently-input frame is: determining whether a hangover interval needs to be set, where if a hangover interval needs to be set, the encoder may encode the currently-input frame into a hangover frame, and if no hangover interval needs to be set, the encoder may encode the currently-input frame into an SID frame.

If the currently-input frame is the $n^{th}$ silence frame and the encoder can determine that the currently-input frame is in a hangover interval, that is, silence frames preceding the currently-input frame are continuously encoded, in step 230, that the encoder determines an encoding manner of the currently-input frame is: determining whether to end the hangover interval, where if the hangover interval needs to be ended, the encoder may encode the currently-input frame into an SID frame, and if the hangover interval needs to be prolonged, the encoder may encode the currently-input frame into a hangover frame.

If the currently-input frame is the $n^{th}$ silence frame and there is no hangover mechanism, in step 230, the encoder needs to determine the encoding manner of the currently-input frame, so that the decoder can obtain a better comfort noise signal after decoding the encoded currently-input frame.

As can be seen, this embodiment of the present invention not only can be applied in a triggering scenario of a hangover mechanism, but also can be applied in an execution scenario of the hangover mechanism, and also can be applied in a scenario in which there is no hangover mechanism. Specifically, in this embodiment of the present invention, whether to trigger the hangover mechanism can be determined, and whether to end the hangover mechanism in advance can also be determined. Alternatively, for a scenario in which there is no hangover mechanism, in this embodiment of the present invention, an encoding manner of a silence frame may be determined, so as to achieve better encoding effects and decoding effects.

Specifically, it may be assumed that the encoder encodes the currently-input frame into an SID frame, if the decoder receives the SID frame, the decoder generates the comfort noise according to the SID frame, and the encoder may predict the comfort noise. Then, the encoder may estimate a deviation degree between the comfort noise and an actual silence signal that is input into the encoder. The deviation degree herein may be understood as a similarity degree. If the predicted comfort noise is close enough to the actual silence signal, the encoder may consider that no hangover interval needs to be set or a hangover interval does not need to be prolonged.

In the prior art, whether to execute a hangover interval at a fixed length is determined by simply collecting statistics on a quantity of active voice frames. That is, if there are enough active voice frames to be continuously encoded, a hangover interval at a fixed length is set. No matter whether the currently-input frame is the first silence frame, or the $n^{th}$ silence frame that is in the hangover interval, the currently-input frame is encoded into the hangover frame. However, unnecessary hangover frames may cause waste of communication bandwidth. However, in this embodiment of the present invention, the encoding manner of the currently-input frame is determined according to the deviation degree between the predicted comfort noise and the actual silence signal, rather than that the currently-input frame is encoded into the hangover frame simply according to a quantity of active voice frames, thereby saving communication bandwidth.

In this embodiment of the present invention, in a case in which an encoding manner of a previous frame of a currently-input frame is a continuous encoding manner, a comfort noise that is generated by a decoder according to the currently-input frame in a case in which the currently-input frame is encoded into an SID frame is predicted, a deviation degree between the comfort noise and an actual silence signal is determined, and it is determined, according to the deviation degree, that an encoding manner of the currently-input frame is a hangover frame encoding manner or an SID frame encoding manner, rather than that the currently-input frame is encoded into a hangover frame simply according to a quantity, obtained through statistics collection, of active voice frames, thereby saving communication bandwidth.

Optionally, as an embodiment, in step 210, the encoder may predict the comfort noise in a first prediction manner, where the first prediction manner is the same as a manner in which the decoder generates the comfort noise.

Specifically, the encoder and the decoder may determine the comfort noise in a same manner; or, the encoder and the decoder may determine the comfort noise in different manners, which is not limited in this embodiment of the present invention.

Optionally, as an embodiment, in step 210, the encoder may predict a feature parameter of the comfort noise and determine a feature parameter of the actual silence signal, where the feature parameter of the comfort noise is in a one-to-one correspondence to the feature parameter of the actual silence signal. In step 220, the encoder may determine a distance between the feature parameter of the comfort noise and the feature parameter of the actual silence signal.

Specifically, the encoder may compare the feature parameter of the comfort noise with the feature parameter of the actual silence signal, to obtain the distance between the feature parameters, so as to determine the deviation degree between the comfort noise and the actual silence signal. The feature parameter of the comfort noise should be in one-to-one correspondence to the feature parameter of the actual silence signal. That is, a type of the feature parameter of the comfort noise is the same as a type of the feature parameter of the actual silence signal. For example, the encoder may compare an energy parameter of the comfort noise with an energy parameter of the actual silence signal, or may also compare a spectral parameter of the comfort noise with a spectral parameter of the actual silence signal.

In this embodiment of the present invention, when the feature parameters are scalars, the distance between the feature parameters may refer to an absolute value of a difference between the feature parameters, that is, a scalar distance. When the feature parameters are vectors, the distance between the feature parameters may refer to the sum of scalar distances of corresponding elements between the feature parameters.

Optionally, as another embodiment, in step 230, the encoder may determine, in a case in which the distance between the feature parameter of the comfort noise and the feature parameter of the actual silence signal is less than a corresponding threshold in a threshold set, that the encoding manner of the currently-input frame is the SID frame encoding manner, where the distance between the feature parameter of the comfort noise and the feature parameter of the actual silence signal is in a one-to-one correspondence to the threshold in the threshold set. The encoder may also determine, in a case in which the distance between the feature parameter of the comfort noise and the feature parameter of the actual silence signal is greater than or equal to the corresponding threshold in the threshold set, that the encoding manner of the currently-input frame is the hangover frame encoding manner.

Specifically, the feature parameter of the comfort noise and the feature parameter of the actual silence signal each may include at least one parameter; therefore, the distance between the feature parameter of the comfort noise and the feature parameter of the actual silence signal may also include a distance between at least one type of parameters. The threshold set may also include at least one threshold. A distance between each type of parameters may correspond to one threshold. When determining the encoding manner of the currently-input frame, the encoder may separately compare the distance between at least one type of parameters with a corresponding threshold in the threshold set. The at least one threshold in the threshold set may be preset, or may also be determined by the encoder according to feature parameters of multiple silence frames preceding the currently-input frame.

If the distance between the feature parameter of the comfort noise and the feature parameter of the actual silence signal is less than the corresponding threshold in the threshold set, the encoder may consider that the comfort noise is close enough to the actual silence signal, and therefore may encode the currently-input frame into an SID frame. If the distance between the feature parameter of the comfort noise and the feature parameter of the actual silence signal is greater than or equal to the corresponding threshold in the threshold set, the encoder may consider that a deviation between the comfort noise and the actual silence signal is relatively large, and therefore may encode the currently-input frame into a hangover frame.

Optionally, as another embodiment, the feature parameter of the comfort noise may be used for representing at least one of the following information: energy information and spectral information.

Optionally, as another embodiment, the energy information may include CELP excitation energy. The spectral information may include at least one of the following: a linear predictive filter coefficient, an FFT coefficient, and an MDCT coefficient. The linear predictive filter coefficient may include at least one of the following: an LSF coefficient, an LSP coefficient, an ISF coefficient, an ISP coefficient, a reflection coefficient, and an LPC coefficient.

Optionally, as another embodiment, in step 210, the encoder may determine that a feature parameter of the currently-input frame is the feature parameter of the actual silence signal. Alternatively, the encoder may collect statistics on feature parameters of M silence frames, to determine the feature parameter of the actual silence signal.

Optionally, as another embodiment, the M silence frames may include the currently-input frame and (M−1) silence frames preceding the currently-input frame, where M is a positive integer.

For example, if the currently-input frame is the first silence frame, the feature parameter of the actual silence signal may be the feature parameter of the currently-input frame; if the currently-input frame is the $n^{th}$ silence frame, the feature parameter of the actual signal may be obtained by the encoder by collecting statistics on feature parameters of the M silence frames including the currently-input frame. The M silence frames may be continuous, or may also be discontinuous, which is not limited in this embodiment of the present invention.

Optionally, as another embodiment, in step 210, the encoder may predict the feature parameter of the comfort noise according to a comfort noise parameter of the previous frame of the currently-input frame and a feature parameter of the currently-input frame. Alternatively, the encoder may predict the feature parameter of the comfort noise according to feature parameters of L hangover frames preceding the currently-input frame and the feature parameter of the currently-input frame, where L is a positive integer.

For example, if the currently-input frame is the first silence frame, the encoder may predict the feature parameter of the comfort noise according to the comfort noise parameter of the previous frame and the feature parameter of the currently-input frame. When encoding each frame, the encoder may save a comfort noise parameter of each frame in the encoder. Usually, only when an input frame is a silence frame, the saved comfort noise parameter may change relative to that of a previous frame, because the encoder may update the saved comfort noise parameter according to a feature parameter of the currently-input silence frame, and usually does not update the comfort noise parameter when the currently-input frame is an active voice frame. Therefore, the encoder may acquire a comfort noise parameter, stored in the encoder, of the previous frame. For example, the comfort noise parameter may include an energy parameter and a spectral parameter of a silence signal.

In addition, if the currently-input frame is currently in a hangover interval, the encoder may collect statistics on parameters of the L hangover frames preceding the currently-input frame, and obtain the feature parameter of the comfort noise according to a result obtained through statistics collection and the feature parameter of the currently-input frame.

Optionally, as another embodiment, the feature parameter of the comfort noise may include CELP excitation energy of the comfort noise and an LSF coefficient of the comfort noise, and the feature parameter of the actual silence signal may include CELP excitation energy of the actual silence signal and an LSF coefficient of the actual silence signal. In step 220, the encoder may determine a distance De between the CELP excitation energy of the comfort noise and the CELP excitation energy of the actual silence signal, and determine a distance Dlsf between the LSF coefficient of the comfort noise and the LSF coefficient of the actual silence signal.

It should be noted that, the distance De and the distance Dlsf may include one variation, or may also include a group of variations. For example, the distance Dlsf may include two variations, where one variation may be an average distance between LSF coefficients, that is, an average value of distances between LSF coefficients, and the other may be a maximum distance between LSF coefficients, that is, a distance between a pair of LSF coefficients having the maximum distance.

Optionally, as another embodiment, in step 230, in a case in which the distance De is less than a first threshold and the distance Dlsf is less than a second threshold, the encoder may determine that the encoding manner of the currently-input frame is the SID frame encoding manner. In a case in which the distance De is greater than or equal to the first threshold or the distance Dlsf is greater than or equal to the second threshold, the encoder may determine that the encoding manner of the currently-input frame is the hangover frame encoding manner. The first threshold and the second threshold both belong to the threshold set.

Optionally, as another embodiment, when De or Dlsf includes a group of variations, the encoder compares each variation in the group of variations with a corresponding threshold, so as to determine a manner for encoding the currently-input frame.

Specifically, the encoder may determine the encoding manner of the currently-input frame according to the distance De and the distance Dlsf. If the distance De<the first threshold and the distance Dlsf<the second threshold, it may indicate that the CELP excitation energy and the LSF coefficient of the predicted comfort noise are slightly different from the CELP excitation energy and the LSF coefficient of the actual silence signal, and the encoder may consider that the comfort noise is close enough to the actual silence signal, and may encode the currently-input frame into an SID frame; otherwise, the encoder may encode the currently-input frame into a hangover frame.

Optionally, as another embodiment, in step 230, the encoder may acquire the preset first threshold and the preset second threshold. Alternatively, the encoder may determine the first threshold according to CELP excitation energy of N silence frames preceding the currently-input frame, and determine the second threshold according to LSF coefficients of the N silence frames, where N is a positive integer.

Specifically, both the first threshold and the second threshold may be preset fixed values. Alternatively, both the first threshold and the second threshold may be self-adaptive variations. For example, the first threshold may be obtained by the encoder by collecting statistics on the CELP excitation energy of the N silence frames preceding the currently-input frame, and the second threshold may be obtained by the encoder by collecting statistics on the LSF coefficients of the N silence frames preceding the currently-input frame, where the N silence frames may be continuous, or may also be discontinuous.

Figure 3A:
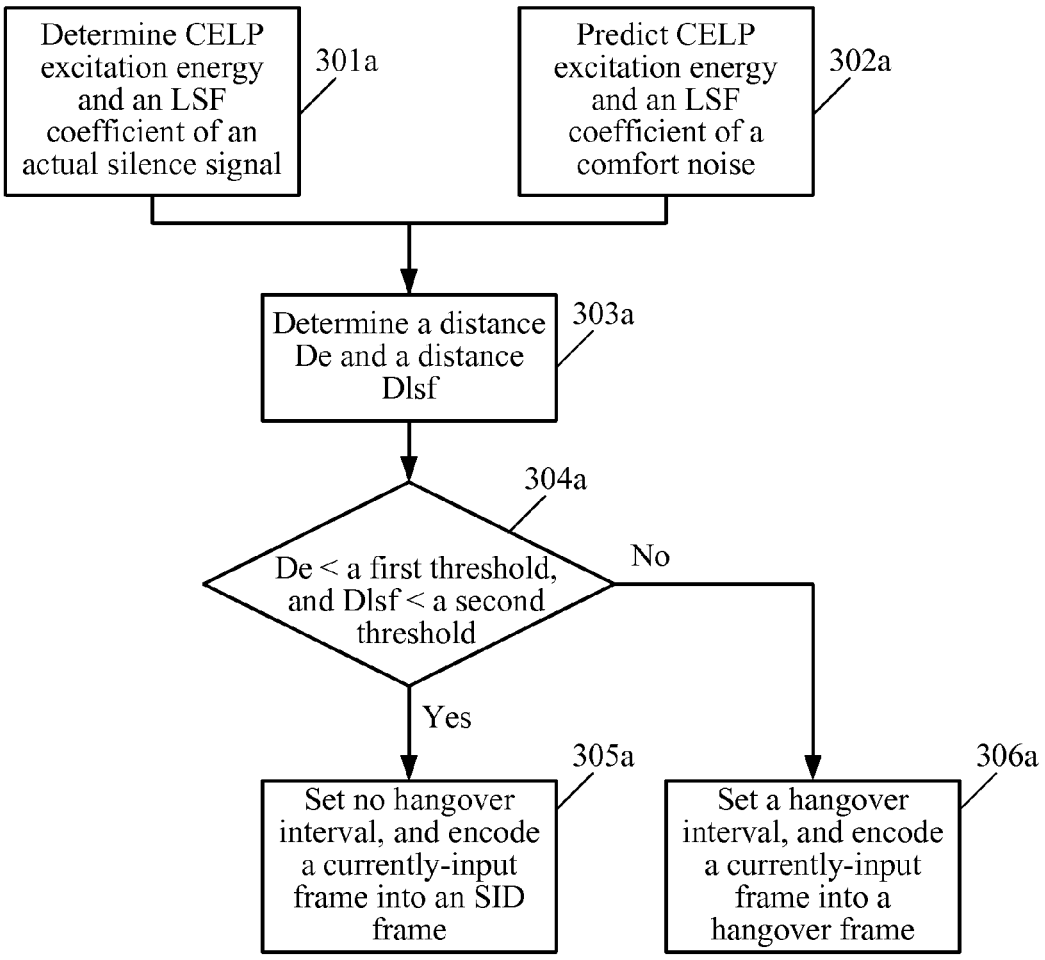
FIG. 3*a* is a flowchart of a process of a signal encoding method according to an embodiment of the present invention.
Figure 3B:
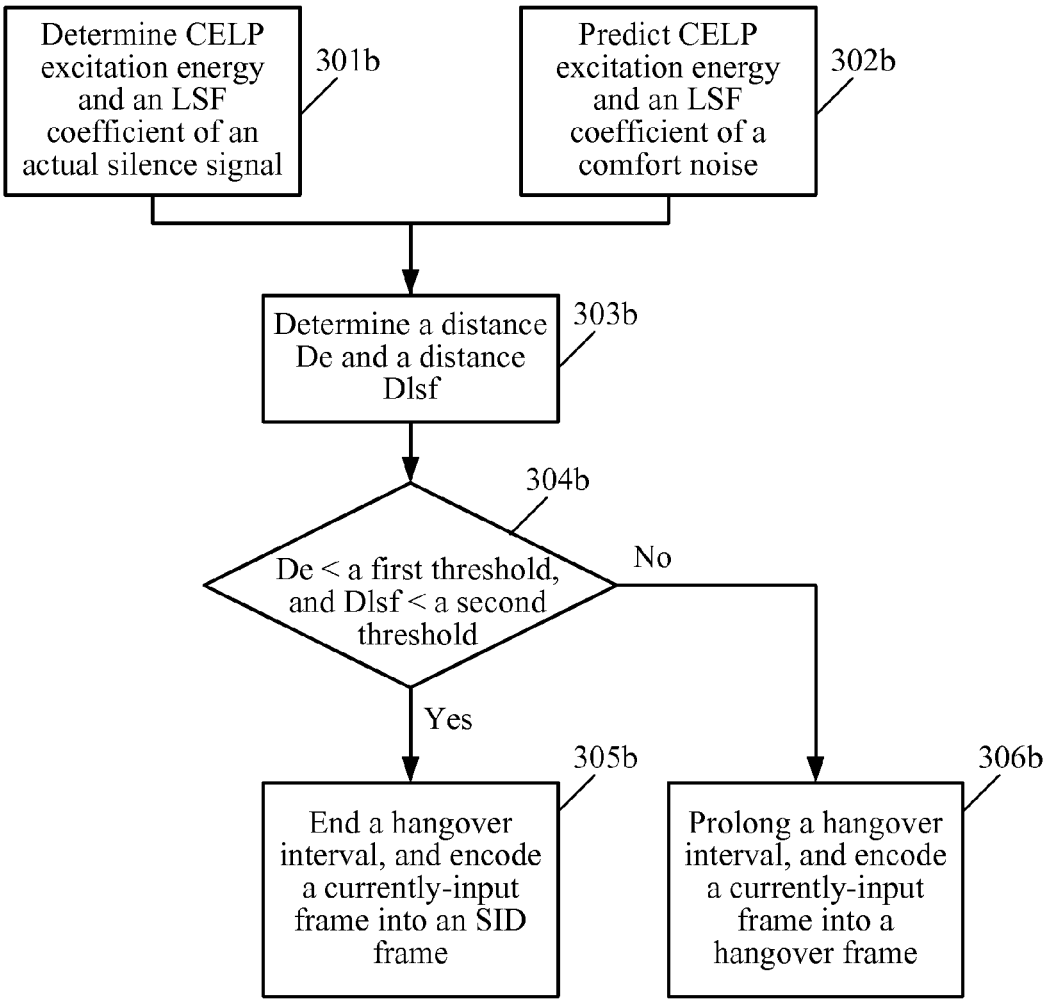
FIG. 3*b* is a flowchart of a process of a signal encoding method according to another embodiment of the present invention.

The following describes a specific process of FIG. 2 in detail by using specific examples. In the examples of FIG. 3*a* and FIG. 3*b*, two scenarios in which this embodiment of the present invention may be applied are used for description. It should be understood that, these examples only intend to help a person skilled in the art better understand this embodiment of the present invention, rather than limiting the scope of this embodiment of the present invention.

FIG. 3*a* is a schematic flowchart of a process of a signal encoding method according to an embodiment of the present invention. In FIG. 3*a*, it is assumed that an encoding manner of a previous frame of a currently-input frame is a continuous encoding manner, and a VAD in an encoder determines that the currently-input frame is the first silence frame after an input voice signal enters a silence band; then, the encoder needs to determine whether to set a hangover interval, that is, needs to determine whether to encode the currently-input frame into a hangover frame or an SID frame. The following describes the process in detail.

301*a*: Determine CELP excitation energy and an LSF coefficient of an actual silence signal.

Specifically, the encoder may use CELP excitation energy e of the currently-input frame as CELP excitation energy eSI of the actual silence signal, and may use an LSF coefficient lsf(i) of the currently-input frame as an LSF coefficient lsfSI(i) of the currently-input frame, where i=0, 1, . . . , K−1, and K is a filter order. The encoder may determine the CELP excitation energy and the LSF coefficient of the currently-input frame with reference to the prior art.

302*a*: Predict CELP excitation energy and an LSF coefficient of a comfort noise that is generated by a decoder according to a currently-input frame in a case in which the currently-input frame is encoded into an SID frame.

It may be assumed that the encoder encodes the currently-input frame into an SID frame, the decoder generates the comfort noise according to the SID frame. The encoder can predict CELP excitation energy eCN and an LSF coefficient lsfCN(i) of the comfort noise, where i=0, 1, . . . , K−1, and K is a filter order. The encoder may separately determine the CELP excitation energy and the LSF coefficient of the comfort noise according to a comfort noise parameter, stored in the encoder, of a previous frame and the CELP excitation energy and the LSF coefficient of the currently-input frame.

For example, the encoder may predict the CELP excitation energy eCN of the comfort noise according to the following equation (1):

$$eCN=0.4*eCN^{[-1]}+0.6*e \tag{1}$$

where $eCN^{[-1]}$ may represent CELP excitation energy of the previous frame, and e may represent the CELP excitation energy of the currently-input frame.

The encoder may predict the LSF coefficient lsfCN(i) of the comfort noise according to the following equation (2), where i=0, 1, . . . , K−1, and K is a filter order:

$$lsfCN(i)=0.4*lsfCN^{[-1]}(i)+0.6*lsf(i) \tag{2}$$

where $lsfCN^{[-1]}(i)$ may represent an LSF coefficient of the previous frame, and 1sf(i) may represent the $i^{th}$ LSF coefficient of the currently-input frame.

303*a*: Determine a distance De between the CELP excitation energy of the comfort noise and the CELP excitation energy of the actual silence signal, and determine a distance Dlsf between the LSF coefficient of the comfort noise and the LSF coefficient of the actual silence signal.

Specifically, the encoder may determine the distance De between the CELP excitation energy of the comfort noise and the CELP excitation energy of the actual silence signal according to the following equation (3):

$$De=|\log_2 eCN-\log_2 e| \tag{3}$$

The encoder may determine the distance Dlsf between the LSF coefficient of the comfort noise and the LSF coefficient of the actual silence signal according to the following equation (4):

$$Dlsf=\sum_{i=0}^{K-1}|lsfCN(i)-lsf(i)| \tag{4}$$

304*a*: Determine whether the distance De is less than a first threshold, and whether the distance Dlsf is less than a second threshold.

Specifically, both the first threshold and the second threshold may be preset fixed values.

Alternatively, both the first threshold and the second threshold may be self-adaptive variations. The encoder may determine the first threshold according to CELP excitation energy of N silence frames preceding the currently-input frame, for example, the encoder may determine the first threshold thr1 according to the following equation (5):

$$thr1=\frac{\sum_{n=0}^{N-1}\left(\log_2 e^n-\log_2\frac{1}{N}\sum_{m=0}^{N-1}e^{[m]}\right)}{N} \tag{5}$$

The encoder may determine the second threshold according to LSF coefficients of N silence frames, for example, the encoder may determine the second threshold thr2 according to the following equation (6):

$$thr2=\frac{\sum_{n=0}^{N-1}\sum_{i=0}^{K-1}(lsf^{[n]}(i)-\frac{1}{N}\sum_{p=0}^{N-1}lsf^{[p]}(i)}{N} \tag{6}$$

In the equation (5) and the equation (6), [x] may represent the $x^{th}$ frame, and x may be n, m, or p. For example, $e^{[m]}$ may represent CELP excitation energy of the $m^{th}$ frame. $lsf^{[n]}(i)$ may represent the $i^{th}$ LSF coefficient of the $n^{th}$ frame, and 1$sf^{[p]}(i)$ may represent the $i^{th}$ LSF coefficient of the $p^{th}$ frame.

305*a*: If the distance De is less than the first threshold and the distance Dlsf is less than the second threshold, determine not to set a hangover interval, and encode the currently-input frame into an SID frame.

If the distance De is less than the first threshold and the distance Dlsf is less than the second threshold, the encoder may consider that the comfort noise that can be generated by the decoder is close enough to the actual silence signal, no hangover interval may be set, and the currently-input frame is encoded into the SID frame.

306*a*: If the distance De is greater than or equal to the first threshold or the distance Dlsf is greater than or equal to the second threshold, determine to set a hangover interval, and encode the currently-input frame into a hangover frame.

In this embodiment of the present invention, it is determined, according to a deviation degree between a comfort noise that is generated by a decoder according to a currently-input frame in a case in which the currently-input frame is encoded into an SID frame and an actual silence signal, that an encoding manner of the currently-input frame is a hangover frame encoding manner or an SID frame encoding manner, rather than that the currently-input frame is encoded into a hangover frame simply according to a quantity, obtained through statistics collection, of active voice frames, thereby saving communication bandwidth.

FIG. 3*b* is a schematic flowchart of a process of a signal encoding method according to another embodiment of the present invention. In FIG. 3*b*, it is assumed that a currently-input frame is already in a hangover interval. An encoder needs to determine whether to end the hangover interval, that is, the encoder needs to determine whether to continue to encode the currently-input frame into a hangover frame or whether to encode the currently-input frame into an SID frame. The following describes the process in detail.

301*b*: Determine CELP excitation energy and an LSF coefficient of an actual silence signal.

Optionally, similar to step 301*a*, the encoder may use CELP excitation energy and an LSF coefficient of the currently-input frame as the CELP excitation energy and the LSF coefficient of the actual silence signal.

Optionally, the encoder may collect statistics on CELP excitation energy of M silence frames including the currently-input frame, to obtain the CELP excitation energy of the actual silence signal, where M≤a quantity of hangover frames, preceding the currently-input frame, within the hangover interval.

For example, the encoder may determine CELP excitation energy eSI of the actual silence signal according to the equation (7):

$$eSI = \log_2\left(\frac{1}{\sum_{j=0}^{M} w(j)} \cdot \sum_{j=0}^{M} w(j) \cdot e^{[-j]}\right) \tag{7}$$

For another example, the encoder may predict an LSF coefficient lsfSI(i) of the actual silence signal according to the following equation (8), where i=0, 1, . . . , K−1, and K is a filter order:

$$lsfSI(i) = \frac{1}{\sum_{j=0}^{M} w(j)} \cdot \sum_{j=0}^{M} w(j) \cdot lsf(i)^{[-j]} \tag{8}$$

In the foregoing equation (7) and equation (8), w(j) may represent a weighting coefficient, $e^{[-j]}$ may represent CELP excitation energy of the $j^{th}$ silence frame preceding the currently-input frame.

302*b*: Predict CELP excitation energy and an LSF coefficient of a comfort noise that is generated by a decoder according to a currently-input frame in a case in which the currently-input frame is encoded into an SID frame.

Specifically, the encoder may separately determine CELP excitation energy eCN and an LSF coefficient lsfCN(i) of the comfort noise according to CELP excitation energy and LSF coefficients of L hangover frames preceding the currently-input frame, where i=0, 1, . . . , K−1, and K is a filter order.

For example, the encoder may determine the CELP excitation energy eCN of the comfort noise according to the following equation (9):

$$eCN = 0.4 * \left(\frac{1}{\sum_{j=0}^{L} w(j)} \cdot \sum_{j=0}^{L} w(j) \cdot eHO^{[-j]}\right) + 0.6 * e \tag{9}$$

where $eHO^{[-j]}$ may represent excitation energy of the $j^{th}$ hangover frame preceding the currently-input frame.

For another example, the encoder may determine the LSF coefficient lsfCN(i) of the comfort noise according to the following equation (10), where i=0, 1, . . . , K−1, and K is a filter order:

$$lsfCN(i) = 0.4 * \left(\frac{1}{\sum_{j=1}^{L} w(j)} \cdot \sum_{j=1}^{L} w(j) \cdot lsfHO(i)^{[-j]}\right) + 0.6 * lsf(i) \tag{10}$$

where $lsfHO(i)^{[-j]}$ may represent the $i^{th}$ LSF coefficient of the $j^{th}$ hangover frame preceding the currently-input frame.

In the equation (9) and the equation (10), w(j) may represent a weighting coefficient.

303*b*: Determine a distance De between the CELP excitation energy of the comfort noise and the CELP excitation energy of the actual silence signal, and determine a distance Dlsf between the LSF coefficient of the comfort noise and the LSF coefficient of the actual silence signal.

For example, the encoder may determine the distance De between the CELP excitation energy of the comfort noise and the CELP excitation energy of the actual silence signal according to the equation (3). The encoder may determine the distance Dlsf between the LSF coefficient of the comfort noise and the LSF coefficient of the actual silence signal according to the equation (4).

304*b*: Determine whether the distance De is less than a first threshold, and whether the distance Dlsf is less than a second threshold.

Specifically, both the first threshold and the second threshold may be preset fixed values.

Alternatively, both the first threshold and the second threshold may be self-adaptive variations. For example, the encoder may determine the first threshold thr1 according to the equation (5), and may determine the second threshold thr2 according to the equation (6).

305*b*: If the distance De is less than the first threshold and the distance Dlsf is less than the second threshold, determine to end the hangover interval, and encode the currently-input frame into an SID frame.

306*b*: If the distance De is greater than or equal to the first threshold or the distance Dlsf is greater than or equal to the second threshold, determine to continue to prolong the hangover interval, and encode the currently-input frame into a hangover frame.

In this embodiment of the present invention, it is determined, according to a deviation degree between a comfort noise that is generated by a decoder according to a currently-input frame in a case in which the currently-input frame is encoded into an SID frame and an actual silence signal, that an encoding manner of the currently-input frame is a hangover frame encoding manner or an SID frame encoding manner, rather than that the currently-input frame is encoded into a hangover frame simply according to a quantity, obtained through statistics collection, of active voice frames, thereby saving communication bandwidth.

As can be seen from the above, after entering a discontinuous transmission state, an encoder may intermittently encode an SID frame. The SID frame generally includes some information describing energy and a spectrum of a silence signal. After receiving the SID frame from the encoder, a decoder may generate a comfort noise according to the information in the SID frame. Currently, because the SID frame is encoded and sent once every several frames, when encoding the SID frame, the encoder usually obtains information of the SID frame by collecting statistics on a currently-input silence frame and several silence frames preceding the currently-input silence frame. For example, within a continuous silence interval, information of a currently-encoded SID frame is usually obtained by collecting statistics on the current SID frame and multiple silence frames between the current SID frame and a previous SID frame. For another example, encoding information of the first SID frame after an active voice band is usually obtained by the encoder by collecting statistics on a currently-input silence frame and several adjacent hangover frames at the end of the active voice band, that is, obtained by collecting statistics on silence frames within a hangover interval. For the convenience of description, multiple silence frames used for collecting statistics on an SID frame encoding parameter is referred to as an analysis interval. Specifically, when an SID frame is encoded, a parameter of the SID frame is obtained by obtaining an average value or a median value of parameters of multiple silence frames within the analysis interval. However, an actual background noise spectrum may include various unexpected transient spectral components. Once the analysis interval includes such spectral components, the components may be added in the SID frame in a method for obtaining an average value, and a silence spectrum including such spectral components may even be incorrectly encoded in the SID frame in a method for obtaining a median value, causing that quality of a comfort noise that is generated by the decoder according to the SID frame decreases.

Figure 4:
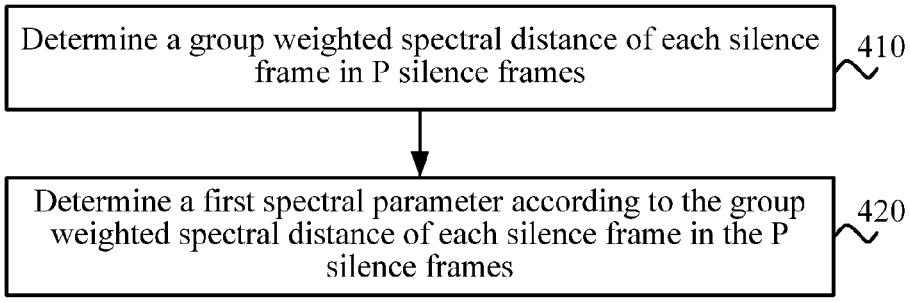
FIG. 4 is a flowchart of a signal processing method according to an embodiment of the present invention.

FIG. 4 is a schematic flowchart of a signal processing method according to an embodiment of the present invention. The method in FIG. 4 is executed by an encoder or a decoder, for example, may be executed by the encoder 110 or the decoder 120 in FIG. 1.

410: Determine a group weighted spectral distance of each silence frame in P silence frames, where the group weighted spectral distance of each silence frame in the P silence frames is the sum of weighted spectral distances between each silence frame in the P silence frames and the other (P−1) silence frames, where P is a positive integer.

For example, the encoder or decoder may store parameters of multiple silence frames preceding a currently-input silence frame into a buffer. A length of the buffer may be fixed or variable. The P silence frames may be selected by the encoder or decoder from the buffer.

420: Determine a first spectral parameter according to the group weighted spectral distance of each silence frame in the P silence frames, where the first spectral parameter is used for generating a comfort noise.

In this embodiment of the present invention, a first spectral parameter used for generating a comfort noise is determined according to a group weighted spectral distance of each silence frame in P silence frames, rather than that a spectral parameter used for generating the comfort noise is obtained simply by obtaining an average value or a median value of spectral parameters of multiple silence frames, thereby improving quality of the comfort noise.

Optionally, as an embodiment, in step 410, the group weighted spectral distance of each silence frame may be determined according to a spectral parameter of each silence frame in the P silence frames. For example, a group weighted spectral distance $swd^{[x]}$ of the $x^{th}$ frame in the P silence frames may be determined according to the following equation (11):

$$swd^{[x]} = \sum_{j=0, j\neq x}^{P-1} \sum_{i=0}^{K-1} w(i)[U^{[x]}(i) - U^{[j]}(i)] \tag{11}$$

where $U^{[x]}(i)$ may represent the $i^{th}$ spectral parameter of the $x^{th}$ frame, $U^{[j]}(i)$ may represent the $i^{th}$ spectral parameter of the $j^{th}$ frame, w(i) may be a weighting coefficient, and K is a quantity of coefficients of a spectral parameter.

For example, the spectral parameter of each silence frame may include an LSF coefficient, an LSP coefficient, an ISF coefficient, an ISP coefficient, an LPC coefficient, a reflection coefficient, an FFT coefficient, or an MDCT coefficient, or the like. Therefore, correspondingly, in step 420, the first spectral parameter may include an LSF coefficient, an LSP coefficient, an ISF coefficient, an ISP coefficient, an LPC coefficient, a reflection coefficient, an FFT coefficient, or an MDCT coefficient, or the like.

The following describes a process of step 420 by using an example in which the spectral parameter is the LSF coefficient. For example, the sum of weighted spectral distances between the LSF coefficient of each silence frame and LSF coefficients of the other (P−1) silence frames, that is, a group weighted spectral distance swd of the LSF coefficient of each silence frame, may be determined, for example, a group weighted spectral distance $swd'^{[x]}$ of an LSF coefficient of the $x^{th}$ frame in the P silence frames may be determined according to the following equation (12), where x= 0, 1, 2, . . . , P−1:

$$swd'^{[x]} = \sum_{j=0, j\neq x}^{P-1} \sum_{i=0}^{K'-1} w'(i)[lsf^{[x]}(i) - lsf^{[j]}(i)] \tag{12}$$

where w'(i) is a weighting coefficient, and K' is a filter order.

Optionally, as an embodiment, each silence frame may correspond to one group of weighting coefficients, where in the one group of weighting coefficients, a weighting coefficient corresponding to a first group of subbands is greater than a weighting coefficient corresponding to a second group of subbands, and perceptual importance of the first group of subbands is greater than perceptual importance of the second group of subbands.

The subbands may be obtained by dividing a spectral coefficient; for a specific process, reference may be made to the prior art. The perceptual importance of the subbands may be determined according to the prior art. Usually, perceptual importance of a low-frequency subband is higher than perceptual importance of a high-frequency subband; therefore, in a simplified embodiment, a weighting coefficient of a low-frequency subband may be greater than a weighting coefficient of a high-frequency subband.

For example, in the equation (12), w'(i) is a weighting coefficient, where i=0, 1, . . . , K'−1. Each silence frame corresponds to one group of weighting coefficients, that is, w'(0) to w'(K'−1). In the one group of weighting coefficients, a weighting coefficient of an LSF coefficient of a low-frequency subband is greater than a weighting coefficient of an LSF coefficient of a high-frequency subband. Because energy of a background noise is mostly concentrated in a low-frequency band, quality of the comfort noise generated by the decoder is mainly determined by quality of a low-frequency band signal, and influence imposed by a spectral distance of an LSF coefficient of a high-frequency band on a final weighted spectral distance should decrease appropriately.

Optionally, as another embodiment, in step 420, a first silence frame may be selected from the P silence frames, so that a group weighted spectral distance of the first silence frame in the P silence frames is the smallest, and it may be determined that a spectral parameter of the first silence frame is the first spectral parameter.

Specifically, that the group weighted spectral distance is the smallest may indicate that the spectral parameter of the first silence frame can best represent generality between spectral parameters of the P silence frames. Therefore, the spectral parameter of the first silence frame may be encoded in an SID frame. For example, for the group weighted spectral distance of the LSF coefficient of each silence frame, the group weighted spectral distance of the LSF coefficient of the first silence frame is the smallest; then, it may indicate that an LSF spectrum of the first silence frame is an LSF spectrum that can best represent generality between LSF spectra of the P silence frames.

Optionally, as another embodiment, in step 420, at least one silence frame may be selected from the P silence frames, so that a group weighted spectral distance of the at least one silence frame in the P silence frames is less than a third threshold, and the first spectral parameter may be determined according to a spectral parameter of the at least one silence frame.

For example, in an embodiment, it may be determined that an average value of the spectral parameter of the at least one silence frame is the first spectral parameter. In another embodiment, it may be determined that a median value of the spectral parameter of the at least one silence frame is the first spectral parameter. In another embodiment, the first spectral parameter may also be determined according to the spectral parameter of the at least one silence frame by using another method in this embodiment of the present invention.

The following gives description still by using an example in which the spectral parameter is the LSF coefficient; then, the first spectral parameter may be a first LSF coefficient. For example, the group weighted spectral distance of the LSF coefficient of each silence frame in the P silence frames may be obtained according to the equation (12). At least one silence frame whose group weighted spectral distance of an LSF coefficient is less than the third threshold is selected from the P silence frames. Then, an average value of an LSF coefficient of the at least one silence frame may be used as a first LSF coefficient. For example, a first LSF coefficient lsfSID(i) may be determined according to the following equation (13), where i=0, 1, . . . , K'−1, and K' is a filter order:

$$lsfSID(i) = \frac{1}{\sum_{j=0, j\neq\{A\}}^{P-1}} \cdot \sum_{j=0, j\neq\{A\}}^{P-1} lsf^{[j]}(i) \tag{13}$$

where {A} may represent a silence frame in the P silence frames except the at least one silence frame, and $lsf^{[j]}(i)$ may represent $i^{th}$ LSF coefficient of the $j^{th}$ frame.

In addition, the third threshold may be preset.

Optionally, as another embodiment, when the method in FIG. 4 is executed by the encoder, the P silence frames may include a currently-input silence frame and (P−1) silence frames preceding the currently-input silence frame.

When the method in FIG. 4 is executed by the decoder, the P silence frames may be P hangover frames.

Optionally, as another embodiment, when the method in FIG. 4 is executed by the encoder, the encoder may encode the currently-input silence frame into an SID frame, where the SID frame includes the first spectral parameter.

In this embodiment of the present invention, an encoder may encode a currently-input frame into an SID frame, so that the SID frame includes a first spectral parameter, rather than that a spectral parameter of the SID frame is obtained simply by obtaining an average value or a median value of spectral parameters of multiple silence frames, thereby improving quality of a comfort noise that is generated by a decoder according to the SID frame.

Figure 5:
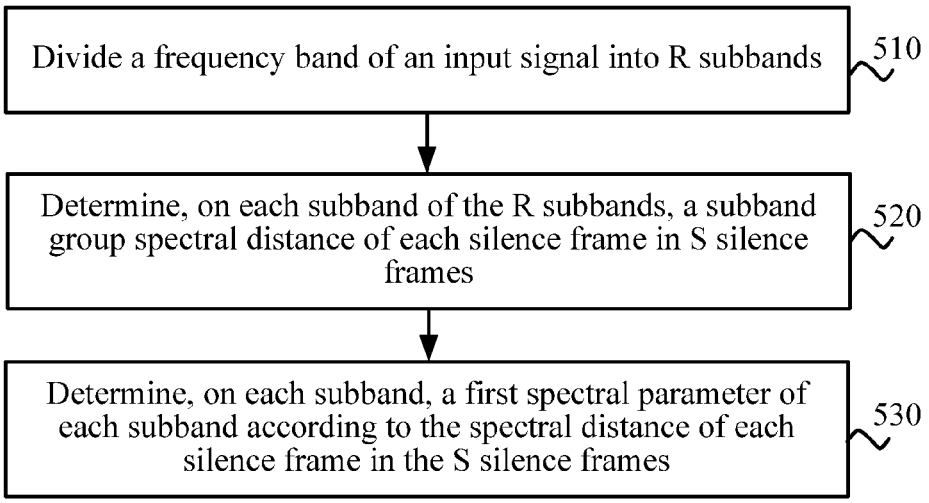
FIG. 5 is a flowchart of a signal processing method according to another embodiment of the present invention.

FIG. 5 is a schematic flowchart of a signal processing method according to another embodiment of the present invention. The method in FIG. 5 is executed by an encoder or a decoder, for example, may be executed by the encoder 110 or the decoder 120 in FIG. 1.

510: Divide a frequency band of an input signal into R subbands, where R is a positive integer.

520: Determine, on each subband of the R subbands, a subband group spectral distance of each silence frame in S silence frames, where the subband group spectral distance of each silence frame in the S silence frames is the sum of spectral distances between each silence frame in the S silence frames on each subband and the other (S−1) silence frames, and S is a positive integer.

530: Determine, on each subband according to the subband group spectral distance of each silence frame in the S silence frames, a first spectral parameter of each subband, where the first spectral parameter of each subband is used for generating a comfort noise.

In this embodiment of the present invention, a first spectral parameter that is of each subband and used for generating a comfort noise is determined on each subband of R subbands according to a subband group spectral distance of each silence frame in S silence frames, rather than that a spectral parameter used for generating the comfort noise is obtained simply by using an average value or a median value of spectral parameters of multiple silence frames, thereby improving quality of the comfort noise.

In step 530, for each subband, the subband group spectral distance of each silence frame on each subband may be determined according to a spectral parameter of each silence frame in the S silence frames. Optionally, as an embodiment, a subband group spectral distance $ssd_k^{[y]}$ of the $y^{th}$ silence frame on the $k^{th}$ subband may be determined according to the following equation (14), where k=1, 2, . . . , R, and y=0, 1, . . . , S−1:

$$ssd_k^{[y]} = \sum_{j=0, j\neq y}^{S-1} \sum_{i=0}^{L(k)-1} \left[U_k^{[y]}(i) - U_k^{[j]}(i)\right] \tag{14}$$

where L(k) may represent a quantity of coefficients of spectral parameters included in the $k^{th}$ subband, $U_k^{[y]}$ may represent the $i^{th}$ coefficient of a spectral parameter of the $y^{th}$ silence frame on the $k^{th}$ subband, and $U_k^{[j]}(i)$ may represent the $i^{th}$ coefficient of a spectral parameter of the $j^{th}$ silence frame on the $k^{th}$ subband.

For example, the spectral parameter of each silence frame may include an LSF coefficient, an LSP coefficient, an ISF coefficient, an ISP coefficient, an LPC coefficient, a reflection coefficient, an FFT coefficient, or an MDCT coefficient, or the like.

The following gives description by using an example in which the spectral parameter is the LSF coefficient. For example, the subband group spectral distance of the LSF coefficient of each silence frame may be determined. Each subband may include one LSF coefficient, or may also include multiple LSF coefficients. For example, a subband group spectral distance $ssd_k^{[y]}$ of an LSF coefficient of the $y^{th}$ silence frame on the $k^{th}$ subband may be determined according to the following equation (15), where k=1, 2, . . . , R, and y=0, 1, . . . , S−1:

$$ssd_k^{[y]} = \sum_{j=0, j\neq y}^{S-1} \sum_{i=0}^{L(k)-1} \left[lsf_k^{[y]}(i) - lsf_k^{[j]}(i)\right] \tag{15}$$

where L(k) may represent a quantity of LSF coefficients included in the $k^{th}$ subband, $lsf_k^{[y]}(i)$ may represent the $i^{th}$ LSF coefficient of the $y^{th}$ silence frame on the $k^{th}$ subband, and $lsf_k^{[j]}(i)$ may represent the $i^{th}$ LSF coefficient of the $j^{th}$ silence frame on the $k^{th}$ subband.

Correspondingly, the first spectral parameter of each subband may include an LSF coefficient, an LSP coefficient, an ISF coefficient, an ISP coefficient, an LPC coefficient, a reflection coefficient, an FFT coefficient, or an MDCT coefficient, or the like.

Optionally, as another embodiment, in step 530, a first silence frame may be selected on each subband from the S silence frames, so that a subband group spectral distance of the first silence frame in the S silence frames on each subband is the smallest. Then, a spectral parameter of the first silence frame on each subband may be used as the first spectral parameter of each subband.

Specifically, the encoder may determine the first silence frame on each subband, and use the spectral parameter of the first silence frame as the first spectral parameter of the subband.

The following gives description still by using an example in which the spectral parameter is the LSF coefficient. Correspondingly, the first spectral parameter of each subband is a first LSF coefficient of each subband. For example, a subband group spectral distance of an LSF coefficient of each silence frame on each subband may be determined according to the equation (15). For each subband, an LSF coefficient of a frame having the smallest subband group spectral distance may be selected as the first LSF coefficient of the subband.

Optionally, as another embodiment, in step 530, at least one silence frame may be selected on each subband from the S silence frames, so that a subband group spectral distance of the at least one silence frame is less than a fourth threshold. Then, the first spectral parameter of each subband may be determined on each subband according to a spectral parameter of at least one silence frame.

For example, in an embodiment, it may be determined that an average value of the spectral parameter of the at least one silence frame in the S silence frames on each subband is the first spectral parameter of each subband. In another embodiment, it may be determined that a median value of the spectral parameter of at least one silence frame in the S silence frames on each subband is the first spectral parameter of each subband. In another embodiment, the first spectral parameter of each subband may also be determined according to the spectral parameter of the at least one silence frame by using another method in the present invention.

Using an LSF coefficient as an example, a subband group spectral distance of an LSF coefficient of each silence frame on each subband may be determined according to the equation (15). For each subband, at least one silence frame whose subband group spectral distance is less than the fourth threshold may be selected, and it is determined that an average value of an LSF coefficient of the at least one silence frame is a first LSF coefficient of the subband. The fourth threshold may be preset.

Optionally, as another embodiment, when the method in FIG. 5 is executed by the encoder, the S silence frames may include a currently-input silence frame and (S−1) silence frames preceding the currently-input silence frame.

When the method in FIG. 5 is executed by the decoder, the S silence frames may be S hangover frames.

Optionally, as another embodiment, when the method in FIG. 5 is executed by the encoder, the encoder may encode the currently-input silence frame into an SID frame, where the SID frame includes the first spectral parameter of each subband.

In this embodiment of the present invention, when encoding an SID frame, an encoder may enable the SID frame to include a first spectral parameter of each subband, rather than that a spectral parameter of the SID frame is obtained simply by obtaining an average value or a median value of spectral parameters of multiple silence frames, thereby improving quality of a comfort noise that is generated by a decoder according to the SID frame.

Figure 6:
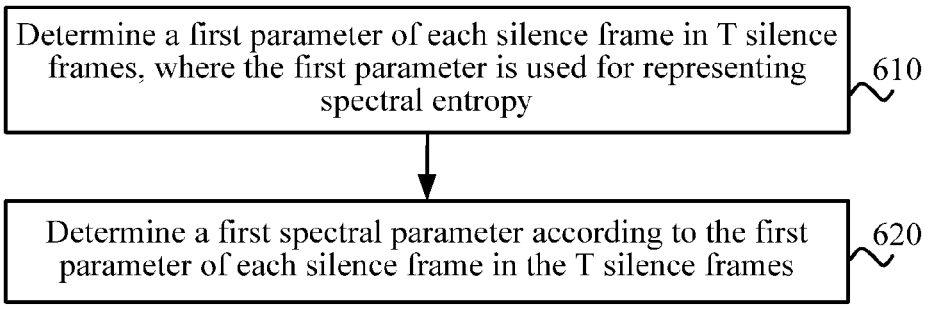
FIG. 6 is a flowchart of a signal processing method according to another embodiment of the present invention.

FIG. 6 is a schematic flowchart of a signal processing method according to another embodiment of the present invention. The method in FIG. 6 is executed by an encoder or a decoder, for example, may be executed by the encoder 110 or the decoder 120 in FIG. 1.

610: Determine a first parameter of each silence frame in T silence frames, where the first parameter is used for representing spectral entropy, and T is a positive integer.

For example, when spectral entropy of the silence frame can be determined directly, the first parameter may be the spectral entropy. In some cases, spectral entropy conforming to a strict definition may not be directly determined, and in this case, the first parameter may be another parameter that can represent spectral entropy, for example, a parameter that can reflect structural strength of a spectrum, or the like.

For example, the first parameter of each silence frame may be determined according to an LSF coefficient of each silence frame. For example, a first parameter of the $z^{th}$ silence frame may be determined according to the following equation (16), where z=1, 2, . . . , T:

$$C^{[z]} = \sum_{i=0}^{K-2} \left[lsf(i+1) - lsf(i) - \frac{1}{K-1}\sum_{j=0}^{K-2}[lsf(j+1) - lsf(j)]\right]^2 \tag{16}$$

where K is a filter order.

Herein, C is a parameter that can reflect structural strength of a spectrum, and does not strictly conform to a definition of spectral entropy, where a larger C may indicate smaller spectral entropy.

620: Determine a first spectral parameter according to the first parameter of each silence frame in the T silence frames, where the first spectral parameter is used for generating a comfort noise.

In this embodiment of the present invention, a first spectral parameter used for generating a comfort noise is determined according to a first parameters that is used for representing spectral entropy and of T silence frames, rather than that a spectral parameter used for generating the comfort noise is obtained simply by obtaining an average value or a median value of spectral parameters of multiple silence frames, thereby improving quality of the comfort noise.

Optionally, as an embodiment, in a case in which it is determined that the T silence frames can be classified into a first group of silence frames and a second group of silence frames according to a clustering criterion, the first spectral parameter may be determined according to a spectral parameter of the first group of silence frames, where spectral entropy represented by first parameters of the first group of silence frames is greater than spectral entropy represented by first parameters of the second group of silence frames; and in a case in which it is determined that the T silence frames cannot be classified into the first group of silence frames and the second group of silence frames according to the clustering criterion, weighted averaging may be performed on spectral parameters of the T silence frames, to determine the first spectral parameter, where the spectral entropy represented by the first parameters of the first group of silence frames is greater than the spectral entropy represented by the first parameters of the second group of silence frames.

Generally, a common noise spectrum has relatively poor structural strength, while a non-noise signal spectrum, or a noise spectrum including a transient component has a relatively strong structural strength. Structural strength of a spectrum directly corresponds to a size of spectral entropy. Relatively, spectral entropy of a common noise may be relatively large, while spectral entropy of a non-noise signal, or a noise including a transient component may be relatively small. Therefore, in the case in which the T silence frames can be classified into the first group of silence frames and the second group of silence frames, the encoder may select, according to the spectral entropy of the silence frame, a spectral parameter of the first group of silence frames not including the transient component, to determine the first spectral parameter.

For example, in an embodiment, it may be determined that an average value of the spectral parameter of the first group of silence frames is the first spectral parameter. In another embodiment, it may be determined that a median value of the spectral parameter of the first group of silence frames is the first spectral parameter. In another embodiment, the first spectral parameter may also be determined according to the spectral parameter of the first group of silence frames by using another method in the present invention.

If the T silence frames cannot be classified into the first group of silence frames and the second group of silence frames, weighted averaging may be performed on the spectral parameters of the T silence frames to obtain the first spectral parameter. Optionally, as another embodiment, the clustering criterion may include: a distance between a first parameter of each silence frame in the first group of silence frames and a first average value is less than or equal to a distance between the first parameter of each silence frame in the first group of silence frames and a second average value; a distance between a first parameter of each silence frame in the second group of silence frames and the second average value is less than or equal to a distance between the first parameter of each silence frame in the second group of silence frames and the first average value; a distance between the first average value and the second average value is greater than an average distance between the first parameters of the first group of silence frames and the first average value; and the distance between the first average value and the second average value is greater than an average distance between the first parameters of the second group of silence frames and the second average value, where the first average value is an average value of the first parameters of the first group of silence frames, and the second average value is an average value of the first parameters of the second group of silence frames.

Optionally, as another embodiment, the encoder may perform weighted averaging on spectral parameters of the T silence frames, to determine the first spectral parameter, where for the $i^{th}$ silence frame and the $j^{th}$ silence frame, which are different, in the T silence frames, a weighting coefficient corresponding to the $i^{th}$ silence frame is greater than or equal to a weighting coefficient corresponding to the $j^{th}$ silence frame; when the first parameter is positively correlated with the spectral entropy, a first parameter of the $i^{th}$ silence frame is greater than a first parameter of the $j^{th}$ silence frame; and when the first parameter is negatively correlated with the spectral entropy, the first parameter of the $i^{th}$ silence frame is less than the first parameter of the $j^{th}$ silence frame, where i and j are both positive integers, and $1 \le i \le T$, and $1 \le j \le T$.

Specifically, the encoder may perform weighted averaging on the spectral parameters of the T silence frames, to obtain the first spectral parameter. As described above, spectral entropy of a common noise may be relatively large, while spectral entropy of a non-noise signal, or a noise including a transient component may be relatively small. Therefore, in the T silence frames, a weighting coefficient corresponding to a silence frame having relatively large spectral entropy may be greater than or equal to a weighting coefficient corresponding to a silence frame having relatively small spectral entropy.

Optionally, as another embodiment, when the method in FIG. 6 is executed by the encoder, the T silence frames may include a currently-input silence frame and (T−1) silence frames preceding the currently-input silence frame.

When the method in FIG. 6 is executed by the decoder, the T silence frames may be T hangover frames.

Optionally, as another embodiment, when the method in FIG. 6 is executed by the encoder, the encoder may encode the currently-input silence frame into an SID frame, where the SID frame includes the first spectral parameter.

In this embodiment of the present invention, when encoding an SID frame, an encoder may enable the SID frame to include a first spectral parameter of each subband, rather than that a spectral parameter of the SID frame is obtained simply by obtaining an average value or a median value of spectral parameters of multiple silence frames, thereby improving quality of a comfort noise that is generated by a decoder according to the SID frame.

Figure 7:
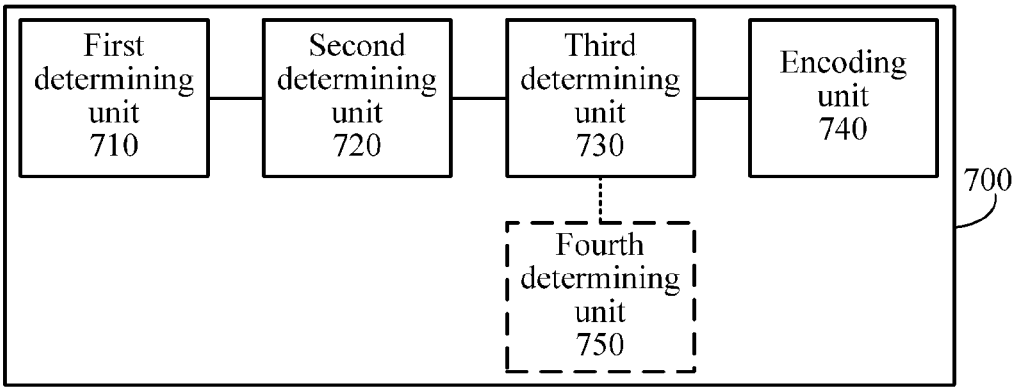
FIG. 7 is a block diagram of a signal encoding device according to an embodiment of the present invention.

FIG. 7 is a schematic block diagram of a signal encoding device according to an embodiment of the present invention. An example of a device 700 in FIG. 7 is an encoder, for example, the encoder 110 shown in FIG. 1. The device 700 includes a first determining unit 710, a second determining unit 720, a third determining unit 730, and an encoding unit 740.

The first determining unit 710 predicts, in a case in which an encoding manner of a previous frame of a currently-input frame is a continuous encoding manner, a comfort noise that is generated by a decoder according to the currently-input frame in a case in which the currently-input frame is encoded into an SID frame, and determines an actual silence signal, where the currently-input frame is a silence frame. The second determining unit 720 determines a deviation degree between the comfort noise determined by the first determining unit 710 and the actual silence signal determined by the first determining unit 710. The third determining unit 730 determines an encoding manner of the currently-input frame according to the deviation degree determined by the second determining unit, where the encoding manner of the currently-input frame includes a hangover frame encoding manner or an SID frame encoding manner. The encoding unit 740 encodes the currently-input frame according to the encoding manner of the currently-input frame determined by the third determining unit 730.

In this embodiment of the present invention, in a case in which an encoding manner of a previous frame of a currently-input frame is a continuous encoding manner, a comfort noise that is generated by a decoder according to the currently-input frame in a case in which the currently-input frame is encoded into an SID frame is predicted, a deviation degree between the comfort noise and an actual silence signal is determined, and it is determined, according to the deviation degree, that an encoding manner of the currently-input frame is a hangover frame encoding manner or an SID frame encoding manner, rather than that the currently-input frame is encoded into a hangover frame simply according to a quantity, obtained through statistics collection, of active voice frames, thereby saving communication bandwidth.

Optionally, as an embodiment, the first determining unit 710 may predict a feature parameter of the comfort noise and determine a feature parameter of the actual silence signal, where the feature parameter of the comfort noise is in a one-to-one correspondence to the feature parameter of the actual silence signal. The second determining unit 720 may determine a distance between the feature parameter of the comfort noise and the feature parameter of the actual silence signal.

Optionally, as another embodiment, the third determining unit 730 may determine, in a case in which the distance between the feature parameter of the comfort noise and the feature parameter of the actual silence signal is less than a corresponding threshold in a threshold set, that the encoding manner of the currently-input frame is the SID frame encoding manner, where the distance between the feature parameter of the comfort noise and the feature parameter of the actual silence signal is in a one-to-one correspondence to the threshold in the threshold set. The third determining unit 730 may determine, in a case in which the distance between the feature parameter of the comfort noise and the feature parameter of the actual silence signal is greater than or equal to the corresponding threshold in the threshold set, that the encoding manner of the currently-input frame is the hangover frame encoding manner.

Optionally, as another embodiment, the feature parameter of the comfort noise may be used for representing at least one of the following information: energy information and spectral information.

Optionally, as another embodiment, the energy information may include CELP excitation energy. The spectral information may include at least one of the following: a linear predictive filter coefficient, an FFT coefficient, and an MDCT coefficient.

The linear predictive filter coefficient may include at least one of the following: an LSF coefficient, an LSP coefficient, an ISF coefficient, an ISP coefficient, a reflection coefficient, and an LPC coefficient.

Optionally, as another embodiment, the first determining unit 710 may predict the feature parameter of the comfort noise according to a comfort noise parameter of the previous frame of the currently-input frame and a feature parameter of the currently-input frame. Alternatively, the first determining unit 710 may predict the feature parameter of the comfort noise according to feature parameters of L hangover frames preceding the currently-input frame and the feature parameter of the currently-input frame, where L is a positive integer.

Optionally, as another embodiment, the first determining unit 710 may determine that the feature parameter of the currently-input frame is the feature parameter of the actual silence signal. Alternatively, the first determining unit 710 may collect statistics on feature parameters of M silence frames, to determine the feature parameter of the actual silence signal.

Optionally, as another embodiment, the M silence frames may include the currently-input frame and (M−1) silence frames preceding the currently-input frame, where M is a positive integer.

Optionally, as another embodiment, the feature parameter of the comfort noise may include code excited linear prediction CELP excitation energy of the comfort noise and a line spectral frequency LSF coefficient of the comfort noise, and the feature parameter of the actual silence signal may include CELP excitation energy of the actual silence signal and an LSF coefficient of the actual silence signal. The second determining unit 720 may determine a distance De between the CELP excitation energy of the comfort noise and the CELP excitation energy of the actual silence signal, and determine a distance Dlsf between the LSF coefficient of the comfort noise and the LSF coefficient of the actual silence signal.

Optionally, as another embodiment, in a case in which the distance De is less than a first threshold and the distance Dlsf is less than a second threshold, the third determining unit 730 may determine that the encoding manner of the currently-input frame is the SID frame encoding manner. In a case in which the distance De is greater than or equal to the first threshold or the distance Dlsf is greater than or equal to the second threshold, the third determining unit 730 may determine that the encoding manner of the currently-input frame is the hangover frame encoding manner.

Optionally, as another embodiment, the device 700 may further include a fourth determining unit 750. The fourth determining unit 750 may acquire the preset first threshold and the preset second threshold. Alternatively, the fourth determining unit 750 may determine the first threshold according to CELP excitation energy of N silence frames preceding the currently-input frame, and determine the second threshold according to LSF coefficients of the N silence frames, where N is a positive integer.

Optionally, as another embodiment, the first determining unit 710 may predict the comfort noise in a first prediction manner, where the first prediction manner is the same as a manner in which the decoder generates the comfort noise.

For other functions and operations of the device 700, reference may be made to the processes of the method embodiments in FIG. 1 to FIG. 3*b* in the foregoing; to prevent repetition, no further details are provided herein again.

Figure 8:
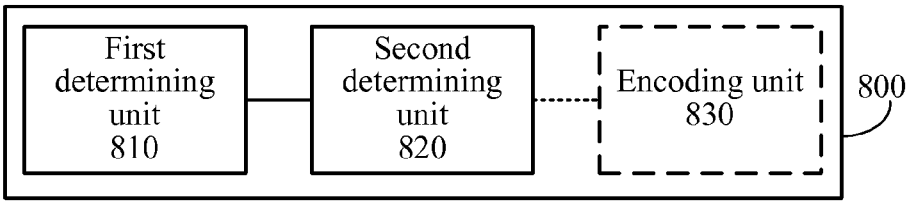
FIG. 8 is a block diagram of a signal processing device according to another embodiment of the present invention.

FIG. 8 is a schematic block diagram of a signal processing device according to another embodiment of the present invention. An example of a device 800 in FIG. 8 is an encoder or a decoder, for example, the encoder 110 or the decoder 120 shown in FIG. 1. The device 800 includes a first determining unit 810 and a second determining unit 820.

The first determining unit 810 determines a group weighted spectral distance of each silence frame in P silence frames, where the group weighted spectral distance of each silence frame in the P silence frames is the sum of weighted spectral distances between each silence frame in the P silence frames and the other (P−1) silence frames, where P is a positive integer. The second determining unit 820 determines a first spectral parameter according to the group weighted spectral distance, determined by the first determining unit 810, of each silence frame in the P silence frames, where the first spectral parameter is used for generating a comfort noise.

In this embodiment of the present invention, a first spectral parameter used for generating a comfort noise is determined according to a group weighted spectral distance of each silence frame in P silence frames, rather than that a spectral parameter used for generating the comfort noise is obtained simply by obtaining an average value or a median value of spectral parameters of multiple silence frames, thereby improving quality of the comfort noise.

Optionally, as an embodiment, each silence frame may correspond to one group of weighting coefficients, where in the one group of weighting coefficients, a weighting coefficient corresponding to a first group of subbands is greater than a weighting coefficient corresponding to a second group of subbands, and perceptual importance of the first group of subbands is greater than perceptual importance of the second group of subbands.

Optionally, as another embodiment, the second determining unit 820 may select a first silence frame from the P silence frames, so that a group weighted spectral distance of the first silence frame in the P silence frames is the smallest, and may determine that a spectral parameter of the first silence frame is the first spectral parameter.

Optionally, as another embodiment, the second determining unit 820 may select at least one silence frame from the P silence frames, so that a group weighted spectral distance of the at least one silence frame in the P silence frames is less than a third threshold, and determine the first spectral parameter according to a spectral parameter of the at least one silence frame.

Optionally, as another embodiment, when the device 800 is the encoder, the device 800 may further include an encoding unit 830.

The P silence frames may include a currently-input silence frame and (P−1) silence frames preceding the currently-input silence frame. The encoding unit 830 may encode the currently-input silence frame into an SID frame, where the SID frame includes the first spectral parameter determined by the second determining unit 820.

For other functions and operations of the device 800, reference may be made to the process of the method embodiment in FIG. 4 in the foregoing; to prevent repetition, no further details are provided herein again.

Figure 9:
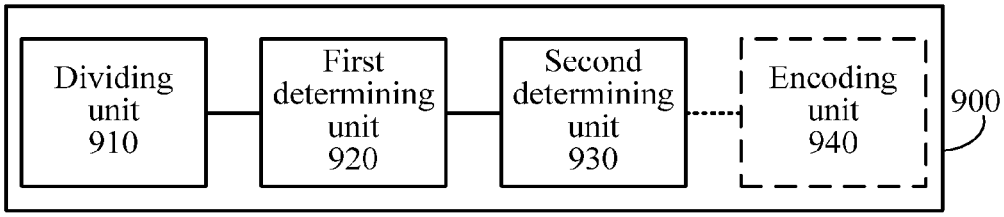
FIG. 9 is a block diagram of a signal processing device according to another embodiment of the present invention.

FIG. 9 is a schematic block diagram of a signal processing device according to another embodiment of the present invention. An example of a device 900 in FIG. 9 is an encoder or a decoder, for example, the encoder 110 or the decoder 120 shown in FIG. 1. The device 900 includes a dividing unit 910, a first determining unit 920, and a second determining unit 930.

The dividing unit 910 divides a frequency band of an input signal into R subbands, where R is a positive integer. The first determining unit 920 determines, on each subband of the R subbands obtained after the dividing unit 910 performs the division, a subband group spectral distance of each silence frame in S silence frames, where the subband group spectral distance of each silence frame in the S silence frames is the sum of spectral distances between each silence frame in the S silence frames on each subband and the other (S−1) silence frames, and S is a positive integer. The second determining unit 930 determines, on each subband, a first spectral parameter of each subband according to a spectral distance, determined by the first determining unit 920, of each silence frame in the S silence frames, where the first spectral parameter of each subband is used for generating a comfort noise.

In this embodiment of the present invention, a spectral parameter that is of each subband and used for generating a comfort noise is determined on each subband of R subbands according to a spectral distance of each silence frame in S silence frames, rather than that the spectral parameter used for generating the comfort noise is obtained simply by obtaining an average value or a median value of spectral parameters of multiple silence frames, thereby improving quality of the comfort noise.

Optionally, as an embodiment, the second determining unit 930 may select, on each subband, a first silence frame from the S silence frames, so that a subband group spectral distance of the first silence frame in the S silence frames on each subband is the smallest, and determine, on each subband, that a spectral parameter of the first silence frame is the first spectral parameter of each subband.

Optionally, as another embodiment, the second determining unit 930 may select, on each subband, at least one silence frame from the S silence frames, so that a subband group spectral distance of the at least one silence frame is less than a fourth threshold, and determine, on each subband, the first spectral parameter of each subband according to a spectral parameter of the at least one silence frame.

Optionally, as another embodiment, when the device 900 is the encoder, the device 900 may further include an encoding unit 940.

The S silence frames may include a currently-input silence frame and (S−1) silence frames preceding the currently-input silence frame. The encoding unit 940 may encode the currently-input silence frame into an SID frame, where the SID frame includes the first spectral parameter of each subband.

For other functions and operations of the device 900, reference may be made to the process of the method embodiment in FIG. 5 in the foregoing; to prevent repetition, no further details are provided herein again.

Figure 10:
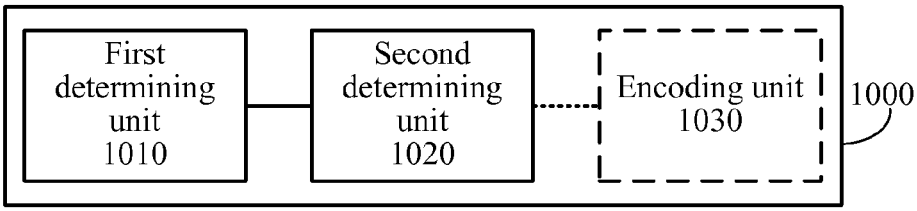
FIG. 10 is a block diagram of a signal processing device according to another embodiment of the present invention.

FIG. 10 is a schematic block diagram of a signal processing device according to another embodiment of the present invention. An example of a device 1000 in FIG. 10 is an encoder or a decoder, for example, the encoder 110 or the decoder 120 shown in FIG. 1. The device 1000 includes a first determining unit 1010 and a second determining unit 1020.

The first determining unit 1010 determines a first parameter of each silence frame in T silence frames, where the first parameter is used for representing spectral entropy, and T is a positive integer. The second determining unit 1020 determines a first spectral parameter according to the first parameter, determined by the first determining unit 1010, of each silence frame in the T silence frames, where the first spectral parameter is used for generating a comfort noise.

In this embodiment of the present invention, a first spectral parameter used for generating a comfort noise is determined according to a first parameters that is used for representing spectral entropy and of T silence frames, rather than that a spectral parameter used for generating the comfort noise is obtained simply by obtaining an average value or a median value of spectral parameters of multiple silence frames, thereby improving quality of the comfort noise.

Optionally, as an embodiment, the second determining unit 1020 may determine, in a case in which it is determined that the T silence frames can be classified into a first group of silence frames and a second group of silence frames according to a clustering criterion, the first spectral parameter according to a spectral parameter of the first group of silence frames, where spectral entropy represented by first parameters of the first group of silence frames is greater than spectral entropy represented by first parameters of the second group of silence frames; and in a case in which it is determined that the T silence frames cannot be classified into the first group of silence frames and the second group of silence frames according to the clustering criterion, perform weighted averaging on spectral parameters of the T silence frames, to determine the first spectral parameter, where the spectral entropy represented by the first parameters of the first group of silence frames is greater than the spectral entropy represented by the first parameters of the second group of silence frames.

Optionally, as another embodiment, the clustering criterion may include: a distance between a first parameter of each silence frame in the first group of silence frames and a first average value is less than or equal to a distance between the first parameter of each silence frame in the first group of silence frames and a second average value; a distance between a first parameter of each silence frame in the second group of silence frames and the second average value is less than or equal to a distance between the first parameter of each silence frame in the second group of silence frames and the first average value; a distance between the first average value and the second average value is greater than an average distance between the first parameters of the first group of silence frames and the first average value; and the distance between the first average value and the second average value is greater than an average distance between the first parameters of the second group of silence frames and the second average value, where the first average value is an average value of the first parameters of the first group of silence frames, and the second average value is an average value of the first parameters of the second group of silence frames.

Optionally, as another embodiment, the second determining unit 1020 may perform weighted averaging on spectral parameters of the T silence frames, to determine the first spectral parameter, where for the $i^{th}$ silence frame and the $j^{th}$ silence frame, which are different, in the T silence frames, a weighting coefficient corresponding to the $i^{th}$ silence frame is greater than or equal to a weighting coefficient corresponding to the $j^{th}$ silence frame; when the first parameter is positively correlated with the spectral entropy, a first parameter of the $i^{th}$ silence frame is greater than a first parameter of the $j^{th}$ silence frame; and when the first parameter is negatively correlated with the spectral entropy, the first parameter of the $i^{th}$ silence frame is less than the first parameter of the $j^{th}$ silence frame, where i and j are both positive integers, and $1 \leq i \leq T$, and $1 \leq j \leq T$.

Optionally, as another embodiment, when the device 1000 is the encoder, the device 1000 may further include an encoding unit 1030.

The T silence frames may include a currently-input silence frame and (T−1) silence frames preceding the currently-input silence frame. The encoding unit 1030 may encode the currently-input silence frame into an SID frame, where the SID frame includes the first spectral parameter.

For other functions and operations of the device 1000, reference may be made to the process of the method embodiment in FIG. 6 in the foregoing; to prevent repetition, no further details are provided herein again.

Figure 11:
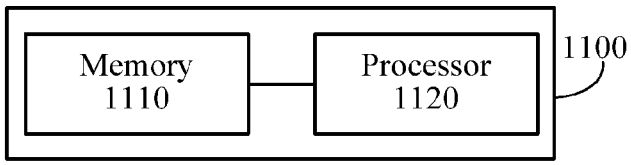
FIG. 11 is a block diagram of a signal encoding device according to another embodiment of the present invention.

FIG. 11 is a schematic block diagram of a signal encoding device according to another embodiment of the present invention. An example of a device 1100 in FIG. 11 is an encoder. The device 1100 includes a memory 1110 and a processor 1120.

The memory 1110 may include a random access memory, a flash memory, a read-only memory, a programmable read-only memory, a non-volatile memory, or a register. The processor 1120 may be a central processing unit (CPU).

The memory 1110 is configured to store an executable instruction. The processor 1120 may execute the executable instruction stored in the memory 1110, to: in a case in which an encoding manner of a previous frame of a currently-input frame is a continuous encoding manner, predict a comfort noise that is generated by a decoder according to the currently-input frame in a case in which the currently-input frame is encoded into an SID frame, and determine an actual silence signal, where the currently-input frame is a silence frame; determine a deviation degree between the comfort noise and the actual silence signal; determine an encoding manner of the currently-input frame according to the deviation degree, where the encoding manner of the currently-input frame includes a hangover frame encoding manner or an SID frame encoding manner; and encode the currently-input frame according to the encoding manner of the currently-input frame.

In this embodiment of the present invention, in a case in which an encoding manner of a previous frame of a currently-input frame is a continuous encoding manner, a comfort noise that is generated by a decoder according to the currently-input frame in a case in which the currently-input frame is encoded into an SID frame is predicted, a deviation degree between the comfort noise and an actual silence signal is determined, and it is determined, according to the deviation degree, that an encoding manner of the currently-input frame is a hangover frame encoding manner or an SID frame encoding manner, rather than that the currently-input frame is encoded into a hangover frame simply according to a quantity, obtained through statistics collection, of active voice frames, thereby saving communication bandwidth.

Optionally, as an embodiment, the processor 1120 may predict a feature parameter of the comfort noise and determine a feature parameter of the actual silence signal, where the feature parameter of the comfort noise is in a one-to-one correspondence to the feature parameter of the actual silence signal. The processor 1120 may determine a distance between the feature parameter of the comfort noise and the feature parameter of the actual silence signal.

Optionally, as another embodiment, the processor 1120 may determine, in a case in which the distance between the feature parameter of the comfort noise and the feature parameter of the actual silence signal is less than a corresponding threshold in a threshold set, that the encoding manner of the currently-input frame is the SID frame encoding manner, where the distance between the feature parameter of the comfort noise and the feature parameter of the actual silence signal is in a one-to-one correspondence to the threshold in the threshold set. The processor 1120 may determine, in a case in which the distance between the feature parameter of the comfort noise and the feature parameter of the actual silence signal is greater than or equal to the corresponding threshold in the threshold set, that the encoding manner of the currently-input frame is the hangover frame encoding manner.

Optionally, as another embodiment, the feature parameter of the comfort noise may be used for representing at least one of the following information: energy information and spectral information.

Optionally, as another embodiment, the energy information may include CELP excitation energy. The spectral information may include at least one of the following: a linear predictive filter coefficient, an FFT coefficient, and an MDCT coefficient. The linear predictive filter coefficient may include at least one of the following: an LSF coefficient, an LSP coefficient, an ISF coefficient, an ISP coefficient, a reflection coefficient, and an LPC coefficient.

Optionally, as another embodiment, the processor 1120 may predict the feature parameter of the comfort noise according to a comfort noise parameter of the previous frame of the currently-input frame and a feature parameter of the currently-input frame. Alternatively, the processor 1120 may predict the feature parameter of the comfort noise according to feature parameters of L hangover frames preceding the currently-input frame and the feature parameter of the currently-input frame, where L is a positive integer.

Optionally, as another embodiment, the processor 1120 may determine that the feature parameter of the currently-input frame is the parameter of the actual silence signal. Alternatively, the processor 1120 may collect statistics on feature parameters of M silence frames, to determine the parameter of the actual silence signal.

Optionally, as another embodiment, the M silence frames may include the currently-input frame and (M−1) silence frames preceding the currently-input frame, where M is a positive integer.

Optionally, as another embodiment, the feature parameter of the comfort noise may include code excited linear prediction CELP excitation energy of the comfort noise and a line spectral frequency LSF coefficient of the comfort noise, and the feature parameter of the actual silence signal may include CELP excitation energy of the actual silence signal and an LSF coefficient of the actual silence signal. The processor 1120 may determine a distance De between the CELP excitation energy of the comfort noise and the CELP excitation energy of the actual silence signal, and determine a distance Dlsf between the LSF coefficient of the comfort noise and the LSF coefficient of the actual silence signal.

Optionally, as another embodiment, in a case in which the distance De is less than a first threshold and the distance Dlsf is less than a second threshold, the processor 1120 may determine that the encoding manner of the currently-input frame is the SID frame encoding manner. In a case in which the distance De is greater than or equal to the first threshold or the distance Dlsf is greater than or equal to the second threshold, the processor 1120 may determine that the encoding manner of the currently-input frame is the hangover frame encoding manner.

Optionally, as another embodiment, the processor 1120 may further acquire the preset first threshold and the preset second threshold. Alternatively, the processor 1120 may further determine the first threshold according to CELP excitation energy of N silence frames preceding the currently-input frame, and determine the second threshold according to LSF coefficients of the N silence frames, where N is a positive integer.

Optionally, as another embodiment, the processor 1120 may predict the comfort noise in a first prediction manner, where the first prediction manner is the same as a manner in which the decoder generates the comfort noise.

For other functions and operations of the device 1100, reference may be made to the processes of the method embodiments in FIG. 1 to FIG. 3*b* in the foregoing; to prevent repetition, no further details are provided herein again.

Figure 12:
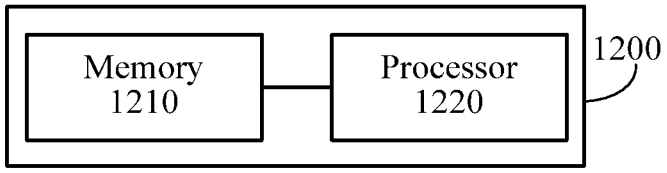
FIG. 12 is a block diagram of a signal processing device according to another embodiment of the present invention.

FIG. 12 is a schematic block diagram of a signal encoding device according to another embodiment of the present invention. An example of a device 1200 in FIG. 12 is an encoder or a decoder, for example, the encoder 110 or the decoder 120 shown in FIG. 1. The device 1200 includes a memory 1210 and a processor 1220.

The memory 1210 may include a random access memory, a flash memory, a read-only memory, a programmable read-only memory, a non-volatile memory, or a register. The processor 1220 may be a CPU.

The memory 1210 is configured to store an executable instruction. The processor 1220 may execute the executable instruction stored in the memory 1210, to: determine a group weighted spectral distance of each silence frame in P silence frames, where the group weighted spectral distance of each silence frame in the P silence frames is the sum of weighted spectral distances between each silence frame in the P silence frames and the other (P−1) silence frames, where P is a positive integer; and determine a first spectral parameter according to the group weighted spectral distance of each silence frame in the P silence frames, where the first spectral parameter is used for generating a comfort noise.

In this embodiment of the present invention, a first spectral parameter used for generating a comfort noise is determined according to a group weighted spectral distance of each silence frame in P silence frames, rather than that a spectral parameter used for generating the comfort noise is obtained simply by obtaining an average value or a median value of spectral parameters of multiple silence frames, thereby improving quality of the comfort noise.

Optionally, as an embodiment, each silence frame may correspond to one group of weighting coefficients, where in the one group of weighting coefficients, a weighting coefficient corresponding to a first group of subbands is greater than a weighting coefficient corresponding to a second group of subbands, and perceptual importance of the first group of subbands is greater than perceptual importance of the second group of subbands.

Optionally, as another embodiment, the processor 1220 may select a first silence frame from the P silence frames, so that a group weighted spectral distance of the first silence frame in the P silence frames is the smallest, and determine that a spectral parameter of the first silence frame is the first spectral parameter.

Optionally, as another embodiment, the processor 1220 may select at least one silence frame from the P silence frames, so that a group weighted spectral distance of the at least one silence frame in the P silence frames is less than a third threshold, and determine the first spectral parameter according to a spectral parameter of the at least one silence frame.

Optionally, as another embodiment, when the device 1200 is the encoder, the P silence frames may include a currently-input silence frame and (P−1) silence frames preceding the currently-input silence frame. The processor 1220 may encode the currently-input silence frame into an SID frame, where the SID frame includes the first spectral parameter.

For other functions and operations of the device 1200, reference may be made to the process of the method embodiment in FIG. 4 in the foregoing; to prevent repetition, no further details are provided herein again.

Figure 13:
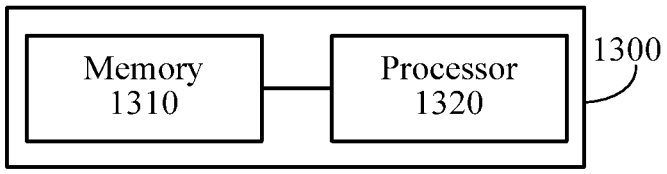
FIG. 13 is a block diagram of a signal processing device according to another embodiment of the present invention.

FIG. 13 is a schematic block diagram of a signal processing device according to another embodiment of the present invention. An example of a device 1300 in FIG. 13 is an encoder or a decoder, for example, the encoder 110 or the decoder 120 shown in FIG. 1. The device 1300 includes a memory 1310 and a processor 1320.

The memory 1310 may include a random access memory, a flash memory, a read-only memory, a programmable read-only memory, a non-volatile memory, or a register. The processor 1320 may be a CPU.

The memory 1310 is configured to store an executable instruction. The processor 1320 may execute the executable instruction stored in the memory 1310, to: divide a frequency band of an input signal into R subbands, where R is a positive integer; determine, on each subband of the R subbands, a subband group spectral distance of each silence frame in S silence frames, where the subband group spectral distance of each silence frame in the S silence frames is the sum of spectral distances between each silence frame in the S silence frames on each subband and the other (S−1) silence frames, and S is a positive integer; and determine, on each subband, a first spectral parameter of each subband according to the subband group spectral distance of each silence frame in the S silence frames, where the first spectral parameter of each subband is used for generating a comfort noise.

In this embodiment of the present invention, a spectral parameter that is of each subband and used for generating a comfort noise is determined on each subband of R subbands according to a spectral distance of each silence frame in S silence frames, rather than that the spectral parameter used for generating the comfort noise is obtained simply by obtaining an average value or a median value of spectral parameters of multiple silence frames, thereby improving quality of the comfort noise.

Optionally, as an embodiment, the processor 1320 may select, on each subband, a first silence frame from the S silence frames, so that a subband group spectral distance of the first silence frame in the S silence frames on each subband is the smallest, and determine, on each subband, that a spectral parameter of the first silence frame is the first spectral parameter of each subband.

Optionally, as another embodiment, the processor 1320 may select, on each subband, at least one silence frame from the S silence frames, so that a subband group spectral distance of the at least one silence frame is less than a fourth threshold, and determine, on each subband, the first spectral parameter of each subband according to a spectral parameter of the at least one silence frame.

Optionally, as another embodiment, when the device 1300 is the encoder, the S silence frames may include a currently-input silence frame and (S−1) silence frames preceding the currently-input silence frame. The processor 1320 may encode the currently-input silence frame into an SID frame, where the SID frame includes the first spectral parameter of each subband.

For other functions and operations of the device 1300, reference may be made to the process of the method embodiment in FIG. 5 in the foregoing; to prevent repetition, no further details are provided herein again.

Figure 14:
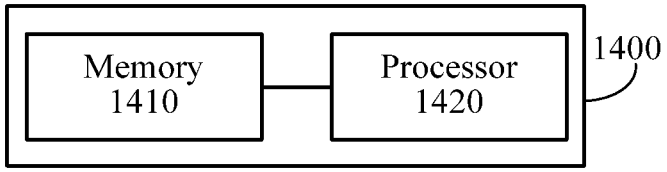
FIG. 14 is a block diagram of a signal processing device according to another embodiment of the present invention.

FIG. 14 is a schematic block diagram of a signal processing device according to another embodiment of the present invention. An example of a device 1400 in FIG. 14 is an encoder or a decoder, for example, the encoder 110 or the decoder 120 shown in FIG. 1. The device 1400 includes a memory 1410 and a processor 1420.

The memory 1410 may include a random access memory, a flash memory, a read-only memory, a programmable read-only memory, a non-volatile memory, or a register. The processor 1420 may be a CPU.

The memory 1410 is configured to store an executable instruction. The processor 1420 may execute the executable instruction stored in the memory 1410, to: determine a first parameter of each silence frame in T silence frames, where the first parameter is used for representing spectral entropy, and T is a positive integer; and determine a first spectral parameter according to the first parameter of each silence frame in the T silence frames, where the first spectral parameter is used for generating a comfort noise.

In this embodiment of the present invention, a first spectral parameter used for generating a comfort noise is determined according to a first parameters that is used for representing spectral entropy and of T silence frames, rather than that a spectral parameter used for generating the comfort noise is obtained simply by obtaining an average value or a median value of spectral parameters of multiple silence frames, thereby improving quality of the comfort noise.

Optionally, as an embodiment, the processor 1420 may determine, in a case in which it is determined that the T silence frames can be classified into a first group of silence frames and a second group of silence frames according to a clustering criterion, the first spectral parameter according to a spectral parameter of the first group of silence frames, where spectral entropy represented by first parameters of the first group of silence frames is greater than spectral entropy represented by first parameters of the second group of silence frames; and in a case in which it is determined that the T silence frames cannot be classified into the first group of silence frames and the second group of silence frames according to the clustering criterion, perform weighted averaging on spectral parameters of the T silence frames, to determine the first spectral parameter, where the spectral entropy represented by the first parameters of the first group of silence frames is greater than the spectral entropy represented by the first parameters of the second group of silence frames.

Optionally, as another embodiment, the clustering criterion may include: a distance between a first parameter of each silence frame in the first group of silence frames and a first average value is less than or equal to a distance between the first parameter of each silence frame in the first group of silence frames and a second average value; a distance between a first parameter of each silence frame in the second group of silence frames and the second average value is less than or equal to a distance between the first parameter of each silence frame in the second group of silence frames and the first average value; a distance between the first average value and the second average value is greater than an average distance between the first parameters of the first group of silence frames and the first average value; and the distance between the first average value and the second average value is greater than an average distance between the first parameters of the second group of silence frames and the second average value, where the first average value is an average value of the first parameters of the first group of silence frames, and the second average value is an average value of the first parameters of the second group of silence frames.

Optionally, as another embodiment, the processor 1420 may perform weighted averaging on spectral parameters of the T silence frames, to determine the first spectral parameter, where for the $i^{th}$ silence frame and the $j^{th}$ silence frame, which are different, in the T silence frames, a weighting coefficient corresponding to the $i^{th}$ silence frame is greater than or equal to a weighting coefficient corresponding to the $j^{th}$ silence frame; when the first parameter is positively correlated with the spectral entropy, a first parameter of the $i^{th}$ silence frame is greater than a first parameter of the $j^{th}$ silence frame; and when the first parameter is negatively correlated with the spectral entropy, the first parameter of the $i^{th}$ silence frame is less than the first parameter of the $j^{th}$ silence frame, where i and j are both positive integers, and $1 \leq i \leq T$, and $1 \leq j \leq T$.

Optionally, as another embodiment, when the device 1400 is the encoder, the T silence frames may include a currently-input silence frame and (T−1) silence frames preceding the currently-input silence frame. The processor 1420 may encode the currently-input silence frame into an SID frame, where the SID frame includes the first spectral parameter.

For other functions and operations of the device 1400, reference may be made to the process of the method embodiment in FIG. 6 in the foregoing; to prevent repetition, no further details are provided herein again.

A person of ordinary skill in the art may be aware that, in combination with the examples described in the embodiments disclosed in this specification, units and algorithm steps may be implemented by electronic hardware or a combination of computer software and electronic hardware. Whether the functions are performed by hardware or software depends on particular applications and design constraint conditions of the technical solutions. A person skilled in the art may use different methods to implement the described functions for each particular application, but it should not be considered that the implementation goes beyond the scope of the present invention.

It may be clearly understood by a person skilled in the art that, for the purpose of convenient and brief description, for a detailed working process of the foregoing system, apparatus, and unit, reference may be made to a corresponding process in the foregoing method embodiments, and details are not described herein again.

In the several embodiments provided in the present application, it should be understood that the disclosed system, apparatus, and method may be implemented in other manners. For example, the described apparatus embodiment is merely exemplary. For example, the unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented by using some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. Some or all of the units may be selected according to actual needs to achieve the objectives of the solutions of the embodiments.

In addition, functional units in the embodiments of the present invention may be integrated into one processing unit, or each of the units may exist alone physically, or two or more units are integrated into one unit.

When the functions are implemented in the form of a software functional unit and sold or used as an independent product, the functions may be stored in a computer-readable storage medium. Based on such an understanding, the technical solutions of the present invention essentially, or the part contributing to the prior art, or some of the technical solutions may be implemented in a form of a software product. The computer software product is stored in a storage medium, and includes several instructions for instructing a computer device (which may be a personal computer, a server, or a network device) to perform all or some of the steps of the methods described in the embodiments of the present invention. The foregoing storage medium includes: any medium that can store program code, such as a USB flash drive, a removable hard disk, a read-only memory (ROM), a random access memory (RAM), a magnetic disk, or an optical disc.

The foregoing descriptions are merely specific implementation manners of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. A voice signal processing method, comprising:

determining a first parameter of each silence frame in T silence frames, wherein the first parameter is used for representing spectral entropy, and T is a positive integer; and determining a first spectral parameter according to a spectral parameter of a first group of silence frames, wherein the first spectral parameter is used for generating a comfort noise, the T silence frames are classified into the first group of silence frames and a second group of silence frames, and spectral entropy represented by first parameters of the first group of silence frames is greater than spectral entropy represented by first parameters of the second group of silence frames.

2. The method according to claim 1, wherein the T silence frames comprise a currently-input silence frame and (T−1) silence frames preceding the currently-input silence frame.

3. The method according to claim 2, further comprising:

encoding the currently-input silence frame into a silence descriptor (SID) frame, wherein the SID frame comprises the first spectral parameter.

4. The method according to claim 1, wherein the step of determining a first parameter of each silence frame in T silence frames comprises:

determining the first parameter of each silence frame according to a line spectral frequency (LSF) coefficient of each silence frame.

5. The method according to claim 1, wherein an average value of the spectral parameter of the first group of silence frames is the first spectral parameter.

6. A voice signal processing device, comprising:

a memory storage comprising instructions; and one or more processors in communication with the memory, wherein the one or more processors execute the instructions to:

determine a first parameter of each silence frame in T silence frames, wherein the first parameter is used for representing spectral entropy, and T is a positive integer; and determine a first spectral parameter according to a spectral parameter of a first group of silence frames, wherein the first spectral parameter is used for generating a comfort noise, the T silence frames are classified into the first group of silence frames and a second group of silence frames, and spectral entropy represented by first parameters of the first group of silence frames is greater than spectral entropy represented by first parameters of the second group of silence frames.

7. The device according to claim 6, wherein the T silence frames comprise a currently-input silence frame and (T−1) silence frames preceding the currently-input silence frame; and wherein the one or more processors execute the instructions to:

encode the currently-input silence frame into a silence descriptor (SID) frame, wherein the SID frame comprises the first spectral parameter.

8. The device according to claim 6, wherein the one or more processors execute the instructions to:

determine the first parameter of each silence frame according to a line spectral frequency (LSF) coefficient of each silence frame.

9. The device according to claim 6, wherein an average value of the spectral parameter of the first group of silence frames is the first spectral parameter.

* * * * *